US005637831A

United States Patent [19]

Lambeth

[11] Patent Number: 5,637,831

[45] Date of Patent: Jun. 10, 1997

[54] ELECTRICAL INSULATORS

[75] Inventor: Peter J. Lambeth, Abinger Hammer, England

[73] Assignee: Hydro Quebec, Montreal, Canada

[21] Appl. No.: 39,411

[22] PCT Filed: Nov. 6, 1991

[86] PCT No.: PCT/GB91/01945

§ 371 Date: Apr. 21, 1993

§ 102(e) Date: Apr. 21, 1993

[87] PCT Pub. No.: WO92/08237

PCT Pub. Date: May 14, 1992

[30] Foreign Application Priority Data

Nov. 6, 1990 [GB] United Kingdom ..... 9024103

[51] Int. Cl.[6] ..... H01B 17/32; H01B 17/50; H01B 17/42

[52] U.S. Cl. ..... 174/209; 174/211; 174/212

[58] Field of Search ..... 174/209, 210, 174/211, 212, 178, 179, 195, 139, 140 R, 141 R, 80; 29/631

[56] References Cited

U.S. PATENT DOCUMENTS

| | | | |
|---|---|---|---|
| 4,053,707 | 10/1977 | Ely et al. | 174/209 |
| 4,833,278 | 5/1989 | Lambeth | 174/139 |
| 5,023,406 | 6/1991 | Thornley | 174/209 |

FOREIGN PATENT DOCUMENTS

| | | | |
|---|---|---|---|
| 0328365 | 8/1989 | European Pat. Off. . | |
| 0283009 | 9/1990 | Germany | 174/140 R |
| 1542845 | 3/1979 | United Kingdom . | |

*Primary Examiner*—Kristine L. Kincaid
*Assistant Examiner*—Paramita Ghosh
*Attorney, Agent, or Firm*—Kirschstein, et al.

[57] ABSTRACT

The present invention relates to a barrier for an insulator having a central portion or stem with a plurality of sheds extending therefrom. The barrier is, in use, located between adjacent sheds of the insulator and includes a sheet of dielectric material having one or more discontinuities in its surface. The discontinuities can be in the form of holes in the surface or in the form of a joint between cut edges of the barrier.

27 Claims, 21 Drawing Sheets

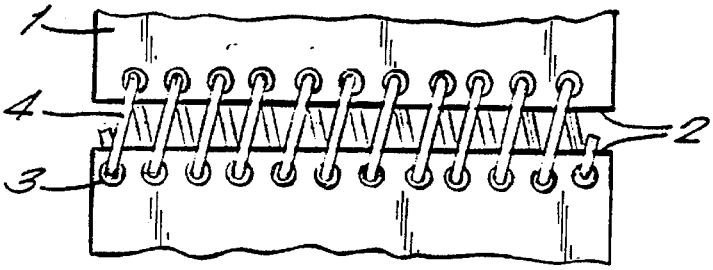
FIG. 2a.
FIG. 2b.
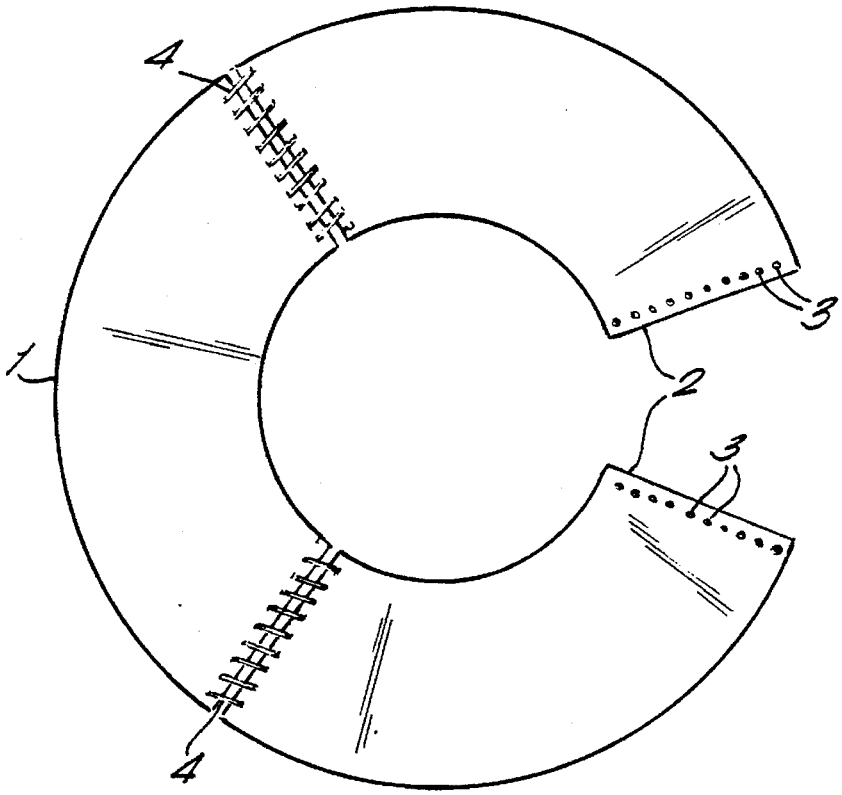
FIG. 3.
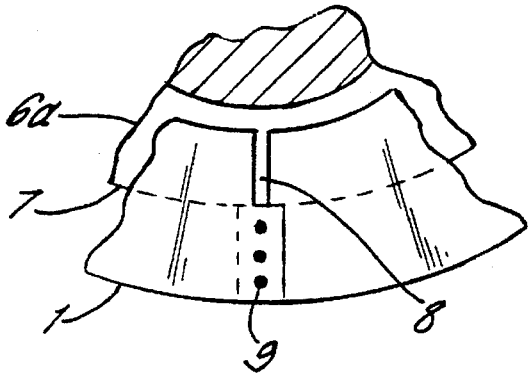

FIG. 4.
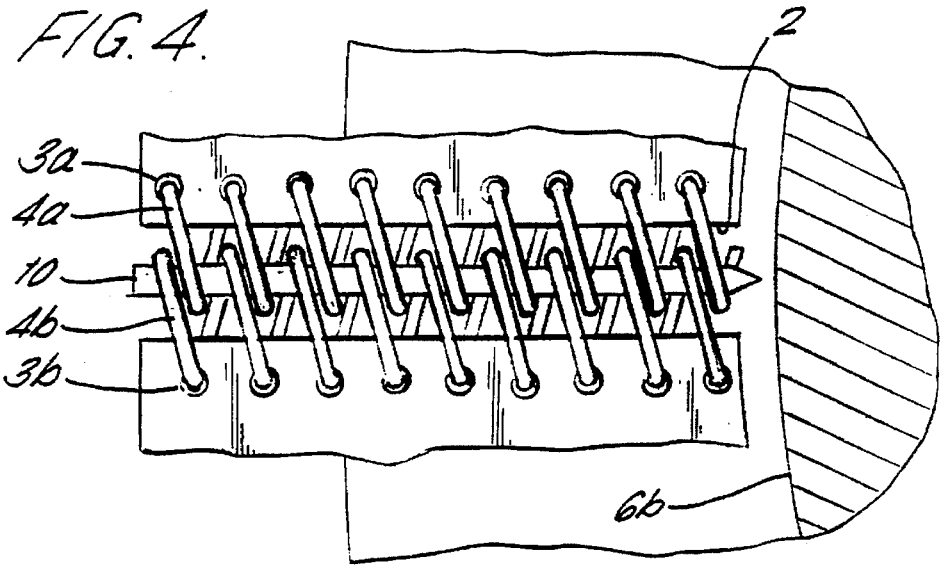
FIG. 5.
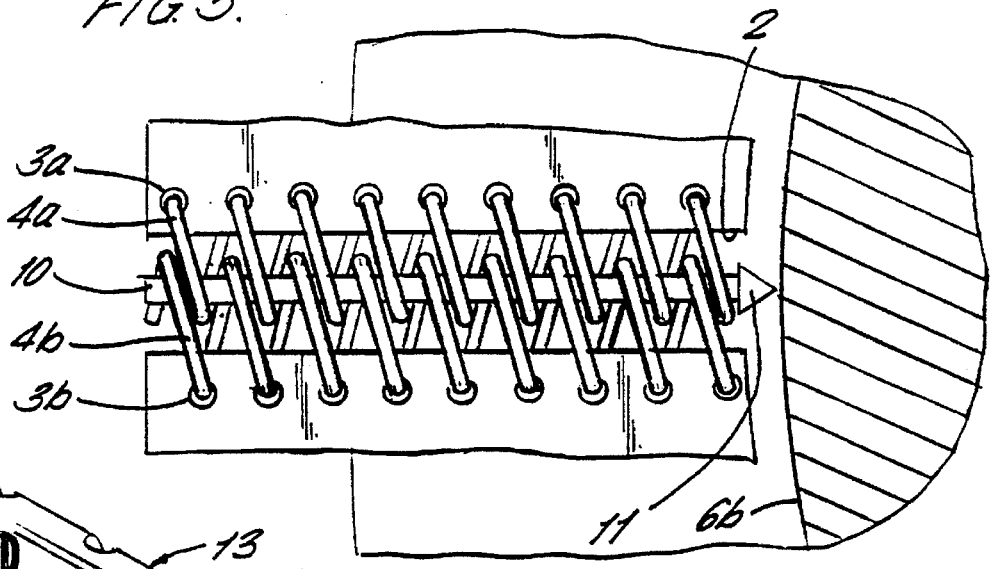
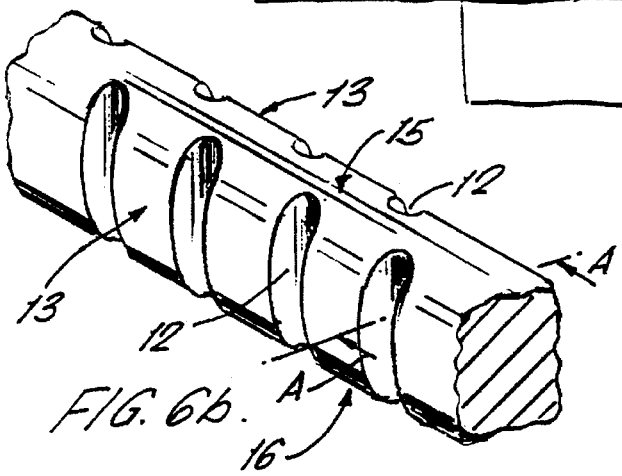
FIG. 6b.
FIG. 6a.
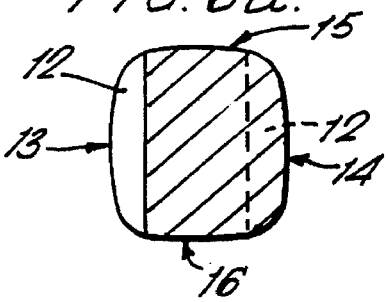

FIG. 7c.
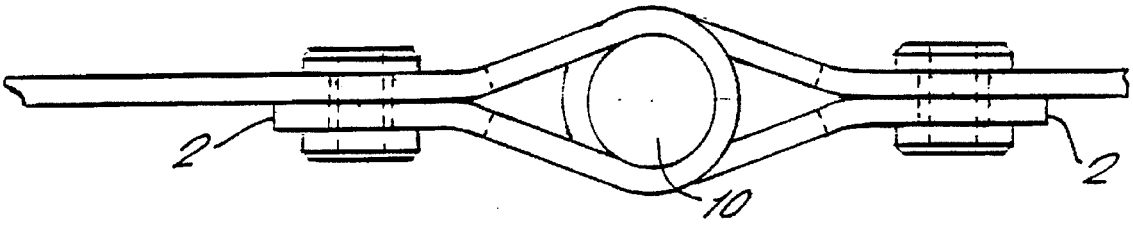
FIG. 7d.
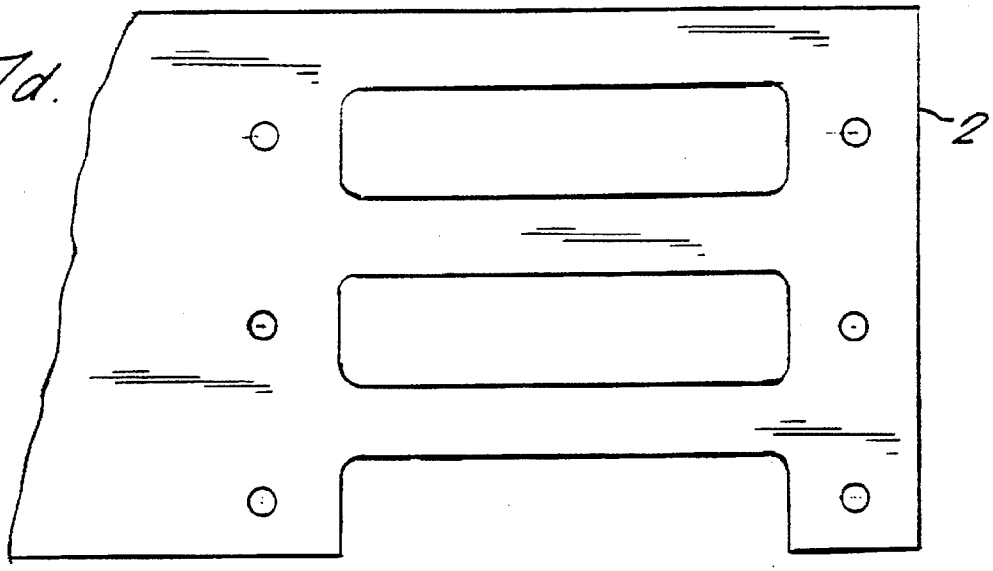
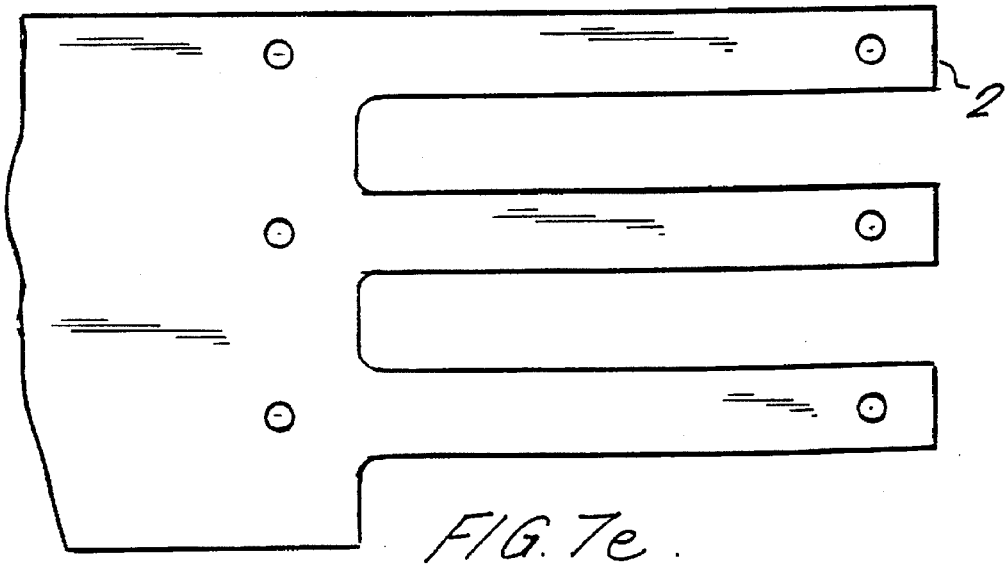
FIG. 7e.

2
10a
20a
19a
18a
17a
1
B
B
51
53
52
50
A
A

A
A
B
B
a
b
c
1
10b
17b
19b
60
60a
60b
61
62
C1
C2

17b
10b
65
60
1
18b
B
A

FIG. 22.
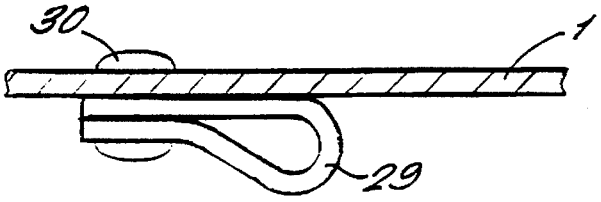
FIG. 23a.
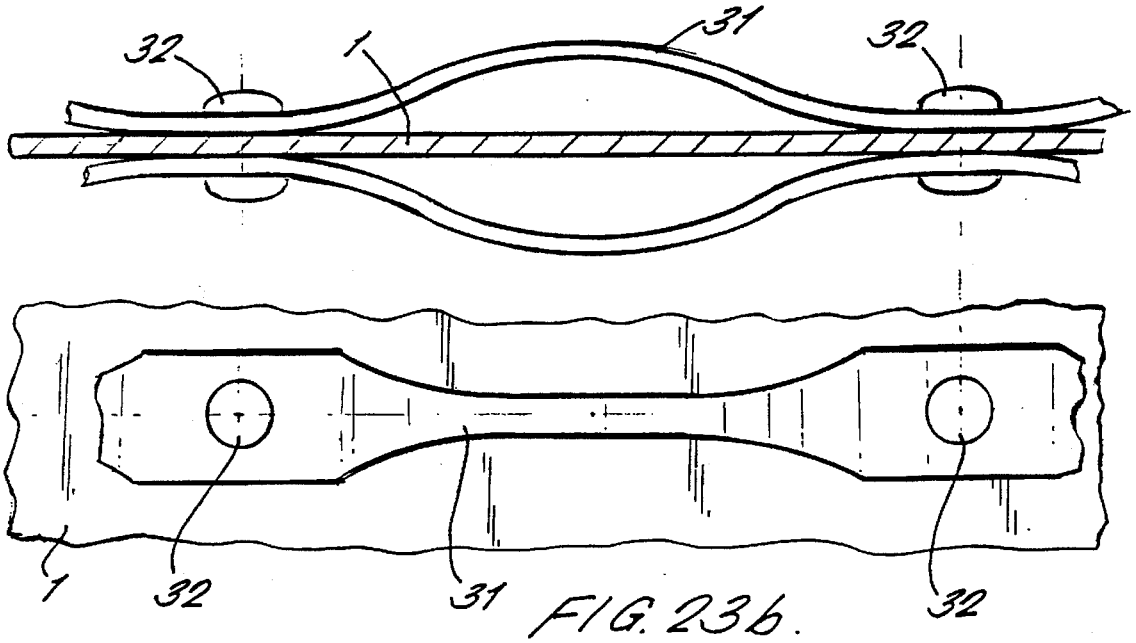
FIG. 23b.

ELECTRICAL INSULATORS

BACKGROUND OF THE INVENTION

1. Field of the Invention

The present invention relates to improvements in or relating to electrical insulators, in particular, high voltage electrical insulators of the type having a central portion from which one or more sheds extend outwardly.

2. Description of Related Art

High voltage electrical insulators of the type suitable for use in power supply systems generally comprise a central stem with sheds extending outwardly therefrom at spaced intervals. Such insulators are typically made of porcelain although other insulating materials may be used.

The main problems encountered with high voltage (h.v.) insulators when used outdoors are those of pollution and wetting of the porcelain. With HVDC wall bushings, in particular near-horizontal bushings, flashover problems arise not only when the bushing is polluted but also when it is clean due to non-uniform wetting when the zone near the earth is well protected from rain by the wall of the valve hall through which it projects.

When there is heavy pollution near-vertical a.c insulators may be washed frequently by means of high pressure water Jets or sprays to remove the pollution layer from the surfaces of the insulator. During the washing process there arises the risk of flashover occurring because water with a high pollution content will be running over the insulator. Accordingly, it has long been considered desirable to reduce the risk of the occurrence of flashover in a variety of heavy wetting conditions. This can be achieved by increasing the flashover voltage or strength of an insulator such that at working voltages flashover will not occur.

It is already known that the provision of several dielectric barriers known as "booster sheds" placed close to the upper surface of a shed on a near-vertical insulator will reduce the risk of flashover. With HVDC wall bushings in the near-horizontal position booster sheds have also been effective in increasing flashover voltage. This is achieved because the flashover strength of the local insulator sheds where the booster sheds are situated is increased. Thus, in critical conditions the voltage on the porcelain sheds near the booster sheds may be higher than on the remaining porcelain sheds. This may have resulted for d.c bushings in the puncturing both of the porcelain sheds as well as the booster sheds during testing. GB1542845 describes such a booster shed which comprises a sheet of dielectric material in the form of a truncated cone which is arranged such that it lies close to the upper surface of a shed. The booster shed is spaced from the surface (or face) of the shed with the lesser angle to the insulator axis by means of small projections which extend downwardly from the lower surface of the booster shed. In addition, the inner edge of the booster shed, which lies closest to the central stem of the insulator, is spaced from the central stem by means of tongues so that there is as little contact between the booster shed and the insulator as possible. The booster shed itself is in the form of a truncated cone formed by removing a sector from an annulus of dielectric material and joining the edges securely by locking means, such as tight-fitting pegs in holes with an insulating filler in the joint to exclude moisture.

Although the booster sheds disclosed in GB1542845 were found to be effective against the risk of flashover, the joint in the dielectric cone is susceptible to puncture, tracking or carbonisation. In addition, these booster sheds have proved expensive to manufacture because they require an elaborate moulding operation to create the various projections. The method of joining the edges of the booster shed once placed over a shed of the insulator has also proved difficult especially when the adjacent sheds of a porcelain insulator are closely spaced. By using a greater number of barriers than the number of booster sheds previously used it is not necessary to have each barrier capable of withstanding the same voltage as the booster sheds had to. In addition, for a given service voltage, a greater number of barriers will reduce the maximum voltage across individual porcelain sheds. The voltage will increase with parameters such as the proximity of the barrier to the porcelain shed, the radial length of the barrier adjacent to the porcelain shed and the overhang of the barrier beyond the porcelain shed. It is therefore a matter of balancing the number of barriers against these parameters, the risk of damage to the porcelain sheds, and the risk of damage to the life of the barriers to obtain the necessary increase in flashover voltage so that in local conditions, for any kind of pollution, there will be few or no flashovers at the working voltage.

There is also the risk of internal puncture of the insulator which is mainly relevant to HVDC bushings and is a serious practical problem. Internal punctures can result in the loss of oil from within the insulator which could lead to fire and hence the loss of a converter station for a substantial period of time. FIG. 1A shows a graph which depicts how the voltage varies along a non-uniformly wetted HVDC wall bushing which is at an angle of approximately 15° to the horizontal between the external high-voltage end and the earthed end which is located at the surface of the wall plotted along the axis of the bushing. Line A shows an idealised representation of the voltage along the surface of the internal paper core of the bushing. Curve B shows the idealised voltage distribution on the external surface of the bushing with a dry zone established at the wall end. The high resistance of this dry zone creates a high voltage drop across it and a corresponding high radial voltage difference indicated by the difference between lines A and B at the edge of the dry zone. If additional dry zones are produced by barriers this will reduce the maximum radial stress at the expense of higher stresses across the sheds along the insulator surface. Curve C depicts the variation in external voltage with four barriers in positions W, X, Y and Z on the insulator. Clearly, the greater the number of barriers the more line C will approximate to the idealised line A. However, it should be pointed out that the graph in FIG. 1A is only a simplified representation of the voltage variation.

Since the mechanism of the flashover process is different for non-uniformly wetted horizontal d.c bushings than for a normal vertical a.c insulator with uniform wetting, different design criteria must be considered. The barriers function differently for direct and alternating voltages and on vertical and near horizontal insulators the following are important considerations:

HORIZONTAL D.C. BUSHINGS (a) The preservation of dry zones on or between sheds has proved difficult with the barriers of the prior art;

(b) there is a risk of internal puncture caused by the dry zone as discussed earlier;

(c) there is an increase in air gap breakdown voltage due to charge accumulation on the barrier. It is considered that this may be a main factor in increasing flashover voltage and applies whether or not there is pollution;

(d) the suppression of arcs between the barriers and the porcelain sheds is an important consideration especially for polluted stations.

VERTICAL A.C BUSHINGS (a) The prevention of water providing a short circuiting of the insulator leakage path by cascading between the porcelain sheds is a major consideration;

(b) the preservation of dry zones on or between the sheds is further improved by using barriers which are additional to the normal screening provided by the sheds themselves;

(c) there is little risk of internal radial puncture because the dry zone is at the high voltage end of a vertical insulator where stress can be withstood by appropriate design features;

(d) the increase in air gap breakdown voltage due to charge accumulation can occur with a.c but it does not appear to be the most important consideration;

(e) the suppression of arcs between the barriers and the porcelain sheds is at least as important as for horizontal bushings since supplementary barriers are more likely to be used only in polluted situations and often in conjunction with washing under voltage.

Therefore, the present invention seeks to overcome the aforementioned disadvantages of the prior art.

SUMMARY OF THE INVENTION

According to the present invention there is provided a barrier for an insulator having a central portion or stem with a plurality of sheds extending therefrom wherein the barrier is, in use, located between adjacent sheds of the insulator and comprises a sheet of dielectric material characterised in that the barrier is spaced from adjacent sheds and has one or more openings therethrough thereby providing an air gap to reduce tracking.

Preferably, the sheet of dielectric material is shaped such that when it is located between the sheds of an insulator it forms a collar, the edges of the collar being connected such that there is a gap therebetween.

Preferably, the collar is formed by a sheet of dielectric material in the shape of an annulus with a sector cut away.

Preferably, the remaining annulus is cut into two or more sectors which are reconnected to form an annulus leaving gaps between the cut edges.

Preferably, a set of holes are provided along each cut edge of the barrier, the sets of holes being staggered with respect to each other and wherein a spiralled rod is threaded through the holes to join the edges.

Preferably, each set of holes has a separate spiralled rod threaded therethrough, the spiralled rods being linked by a straight rod passing through a spiral of each rod alternately.

Preferably, the straight rod has an arrow-shaped tip to facilitate its introduction and prevent withdrawal from the spiralled rods.

Preferably, the rod is provided with spaced grooves extending transversely to the longitudinal axis of the rod which can co-operate with the spiralled rods to secure the join in the barrier.

Preferably, each edge of the collar is fitted with a set of spaced protrusions, one set of protrusions being staggered with respect to the other, the protrusions being linked by a rod passing through a protrusion of each set alternately.

Preferably, each edge of the collar is fitted with a separate component forming a set of spaced protrusions, the protrusions of one set being linked with the protrusions of the other set by a rod passing therethrough.

Preferably, each edge of the collar is cut, folded back and secured to form a set of spaced protrusions, the protrusions of one set being linked to the protrusions of the other set by a rod passing therethrough.

Preferably, each edge of the collar is provided with teeth which interlock with one set of spaced protrusions respectively.

Preferably, the barrier further comprises means for spacing the barrier between adjacent sheds.

Preferably, the spacing means comprise projections located on a flexible elongate element which can be wrapped around the barrier.

Preferably, the dielectric sheet is provided with holes.

Preferably, the means for spacing the barrier between sheds are located in one or more of the holes.

Preferably, the spacing means position the barrier such that, in use, it is substantially equidistant between adjacent sheds.

Preferably, in use, the entire inner periphery of the barrier is spaced radially from the central portion of the insulator.

Preferably, flexible pegs are located in the holes to space the barrier as required.

Preferably, the peg has a hole therethrough which allows passage of a discharge through the barrier.

Preferably, a flexible insulating filament is threaded through the holes to space the barrier as required.

Preferably, the holes are spaced around the inner periphery of the barrier and the flexible insulating filament is threaded through a hole in one direction then passed around the inner periphery and through the next and subsequent holes in the same direction thus providing spacing both between sheds and from the central stem of the insulator.

Preferably, the filament is provided with spiralled grooves.

Preferably, the means for spacing the barrier between the sheds is a strip of flexible material secured in a loop through one or more holes in the barrier.

Preferably, the means for spacing the barrier between the sheds are moulded undulating sections secured through one or more holes in the barrier.

Preferably, the means for spacing the barrier between the sheds and from the insulator core is one or more clips fitted through holes in the inner periphery of the barrier.

Preferably, the spacing of the inner periphery of the barrier from the central portion of the insulator is at least 3 mm.

Preferably, the barrier extends beyond the outer periphery of a shed by at least 10 mm .

Preferably, the barrier is, in use, provided with a cover plate over its connecting edges.

In a further aspect the present invention provides an insulator provided with at least two barriers which are spaced from and adjacent to each other.

BRIEF DESCRIPTION OF THE DRAWINGS

Preferably, the barriers lie at different angles to the longitudinal axis of the insulator.

The present invention also provides a barrier for an insulator having a central portion or stem with a plurality of sheds extending therefrom characterised in that the barrier is in the form of a collar located between and spaced from adjacent sheds and is provided with a cover plate over the connecting edges of the collar.

Preferably, the cover plate is spaced from the connecting edges of the collar.

The present invention also provides a method of improving an insulator having a central portion or stem with a plurality of sheds extending outwardly therefrom comprising the step of forming one or more barriers from a sheet of dielectric material and placing the sheet(s) around the insulator to form one or more discontinuous dielectric surface(s) between the sheds characterised in that the barrier or barriers are spaced from adjacent sheds and have one or more openings therethrough, thereby providing an air gap to reduce tracking.

Preferably, the method further comprises the steps of fitting a separate component to each edge of the collar, each component forming a set of spaced protrusions, placing the collar around the insulator, locating the protrusions on one component between those on the other component, passing a rod through the protrusions of each component to link the components and locking the rod in place to thereby secure the collar around the insulator.

Figure 1:
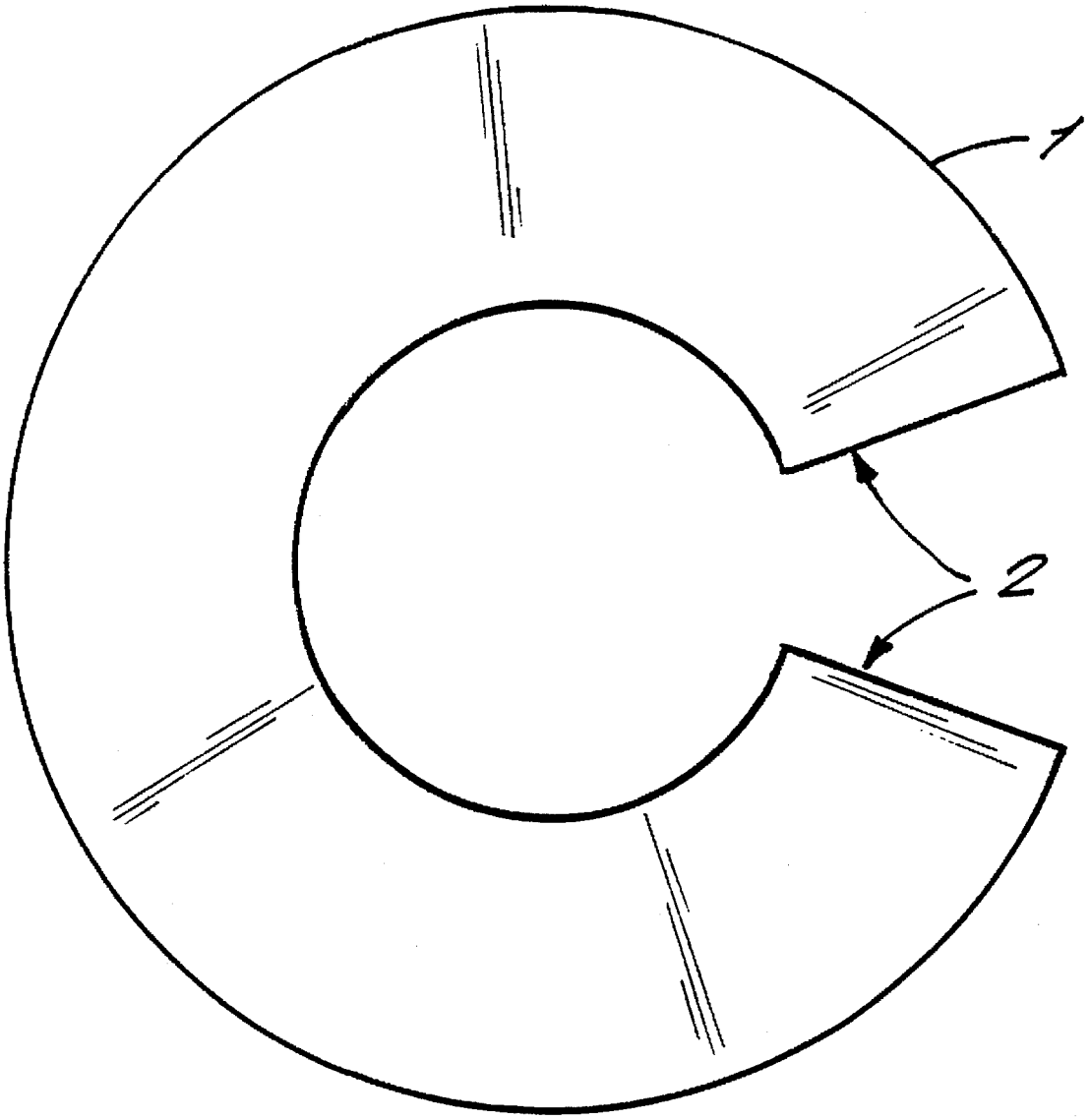
Figure 1A:
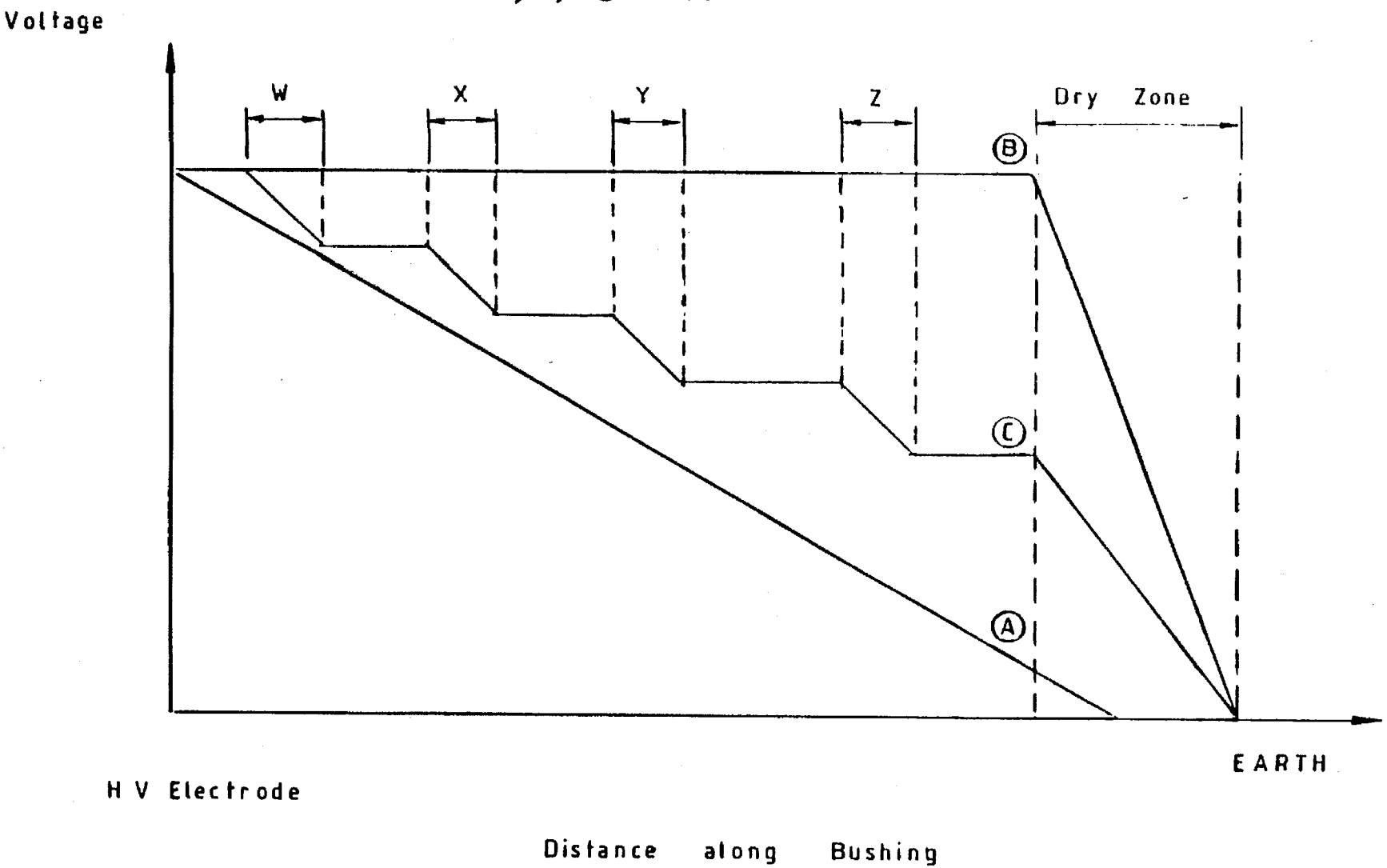
Figure 7A:
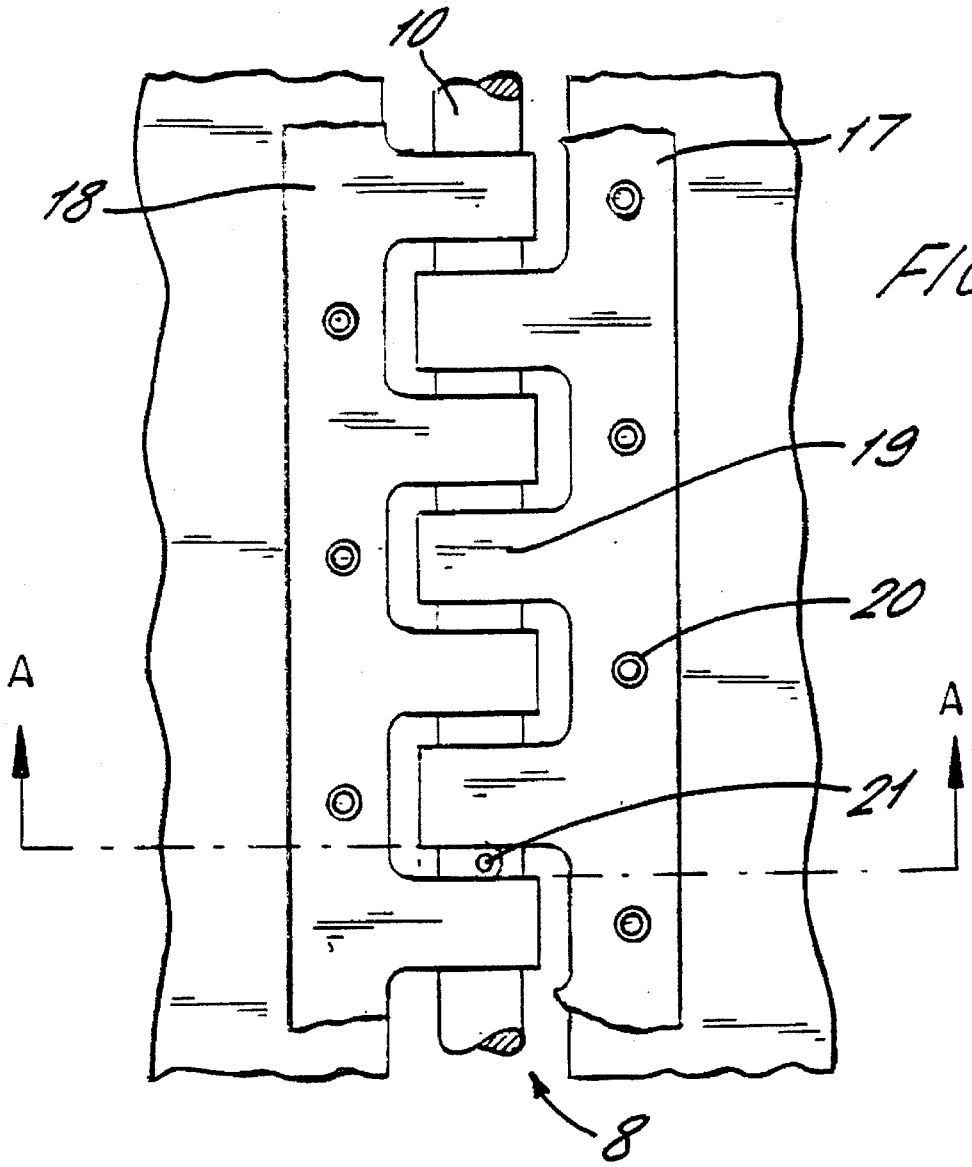
Figure 7B:
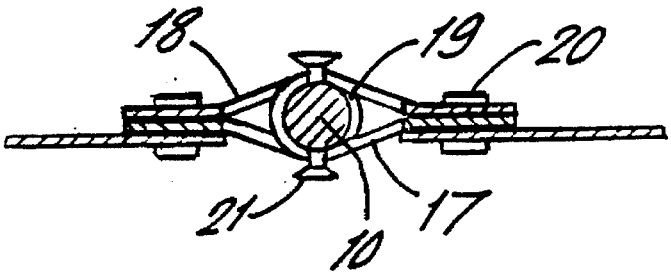

Preferred embodiments of the present invention will now be described in detail, by way of example only, with reference to the accompanying drawings, of which:

FIG. 1A is a graph of voltage variation with distance along a high voltage d.c wall bushing;

FIG. 1 is a plan view of a sheet of dielectric material cut into shape prior to formation of a barrier;

FIG. 2*a* is a partial view of a jointed barrier according to a preferred embodiment of the present invention;

FIG. 2*b* shows how several smaller segments can be jointed for larger insulators;

FIG. 3 is a partial plan view of a jointed barrier in location on an insulator according to a further embodiment of the present invention;

FIG. 4 is a partial plan view of a jointed barrier according to a further embodiment of the present invention;

FIG. 5 is a partial plan view of a jointed barrier according to a further preferred embodiment;

FIGS. 6*a* and 6*b* are a cross-sectional view and a partial perspective view respectively of a rod suitable for use in the joints depicted in FIGS. 4 and 5;

FIG. 7*a* is a partial plan view of a jointed barrier according to a further preferred embodiment;

FIG. 7*b* is a view in direction A—A of FIG. 7*a;*

FIG. 7*c* is a similar view to FIG. 7*b* where the edges of the barrier form jointing loops;

FIGS. 7*d* and 7*e* are plan views of two alternative ways in which one might cut the material to form the joint in FIG. 7*c;*

Figures 8A, 8B, 8C:
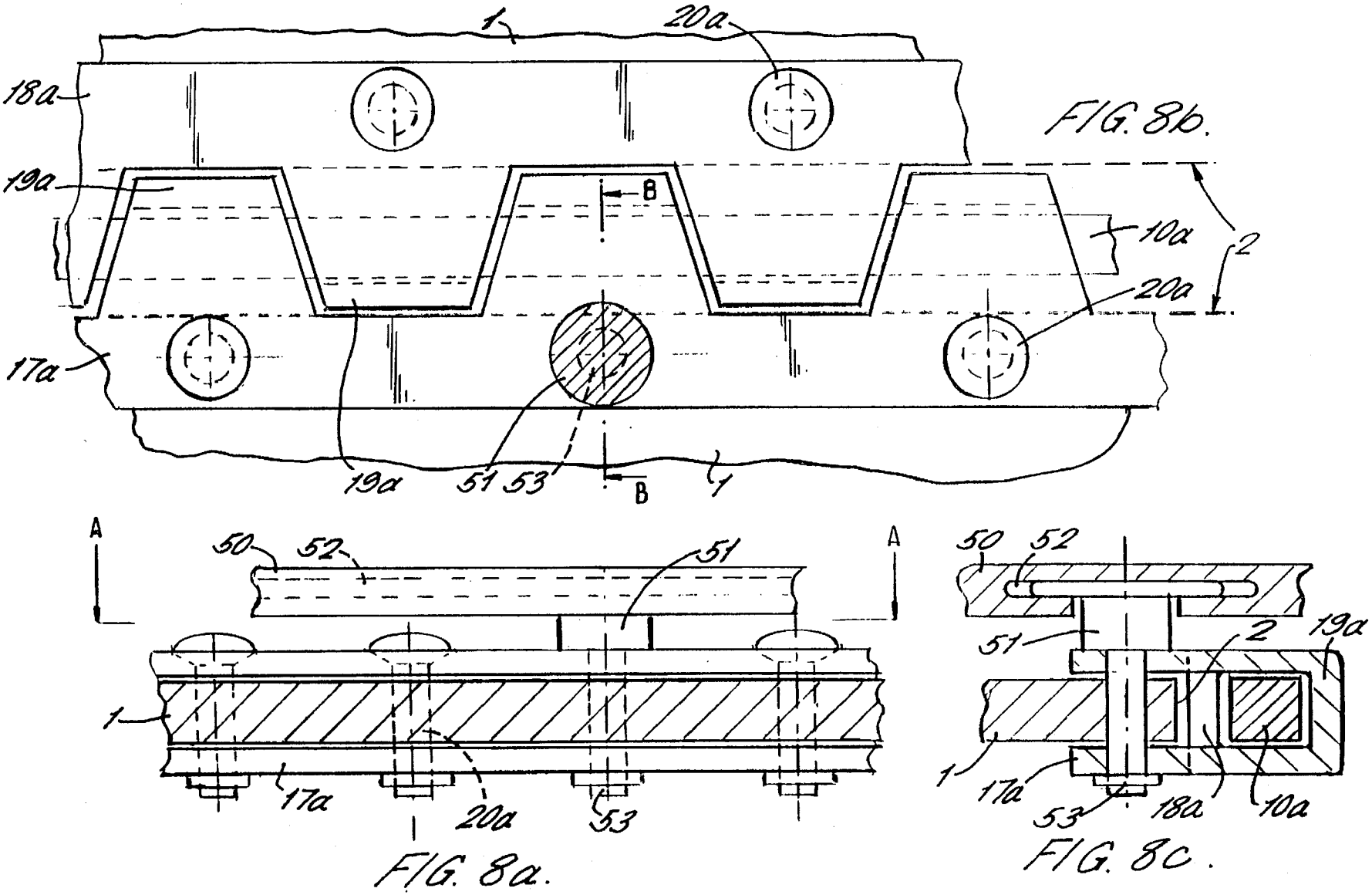

FIGS. 8*a*, 8*b* and 8*c* are views of an alternative jointed barrier to FIG. 7*a;*

Figures 9A, 9B, 9C:
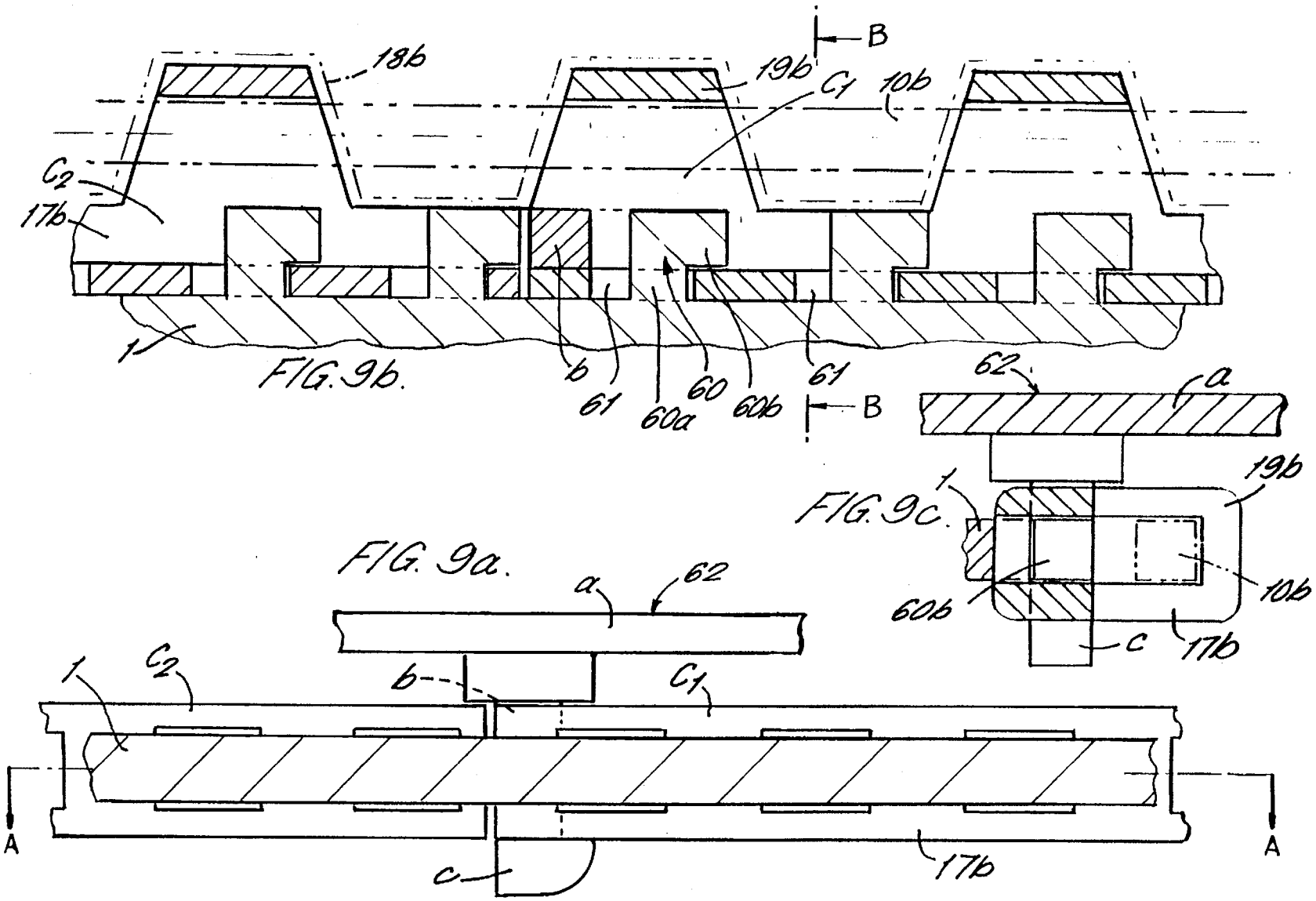

FIGS. 9*a*, 9*b* and 9*c* are views of an alternative jointed barrier to FIGS. 7*a* and 8*a;*

Figure 10:
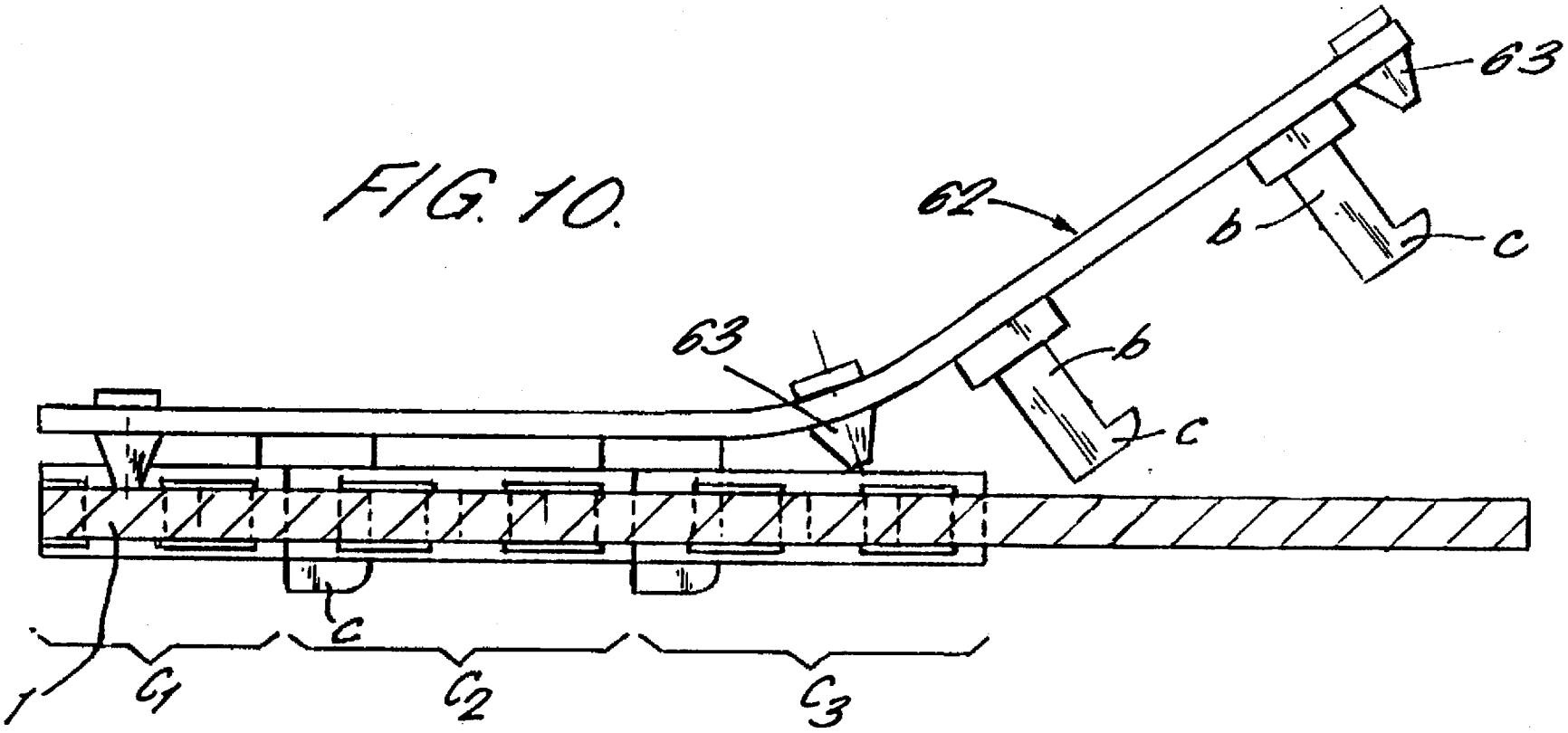
Figures 11A, 11B, 11C:
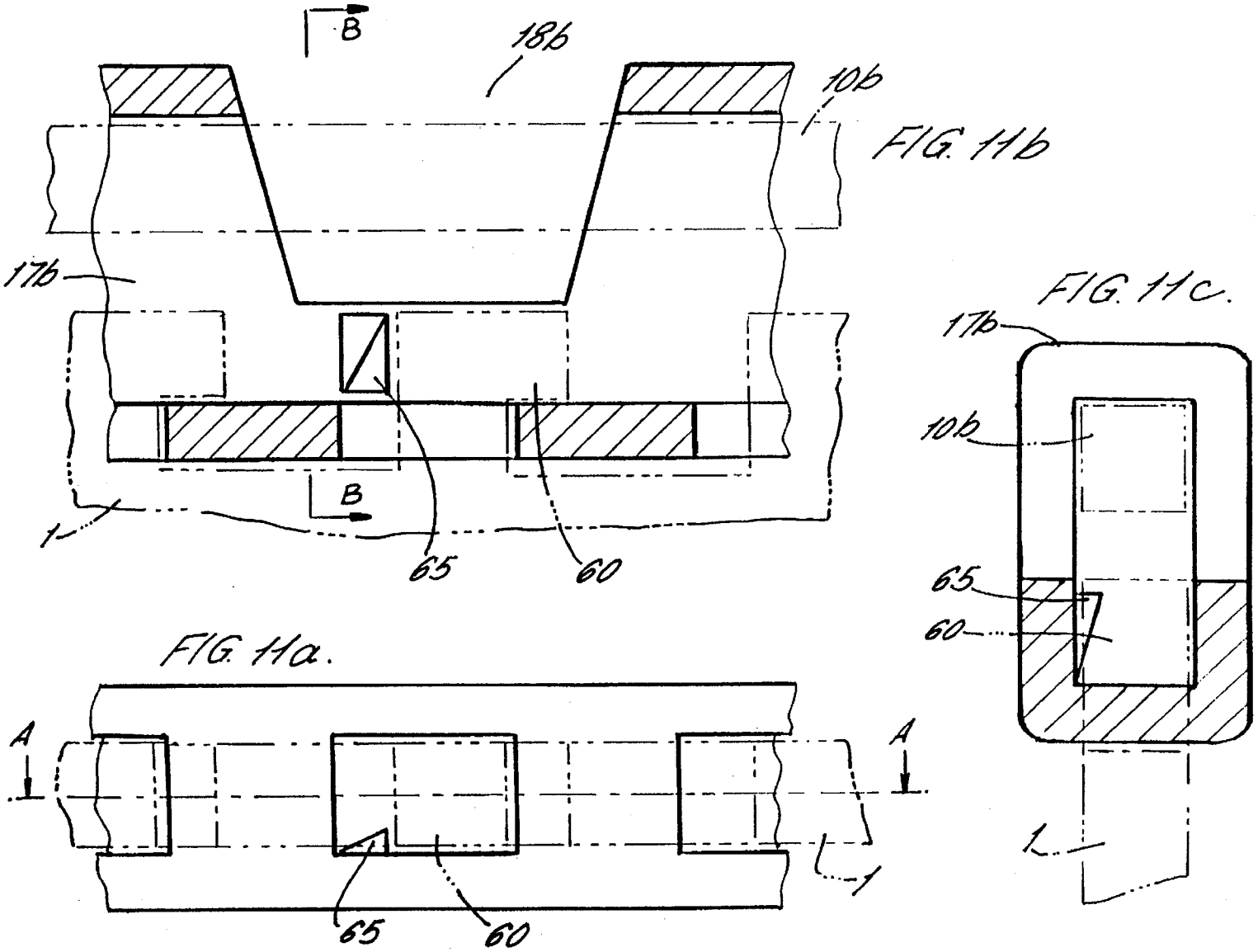

FIG. 10 depicts how the cover plate in FIG. 9*a* is joined to the barrier;

FIGS. 11*a*, 11*b* and 11*c* are views of a modification to the jointed barrier in FIG. 9*a;*

Figure 12A:
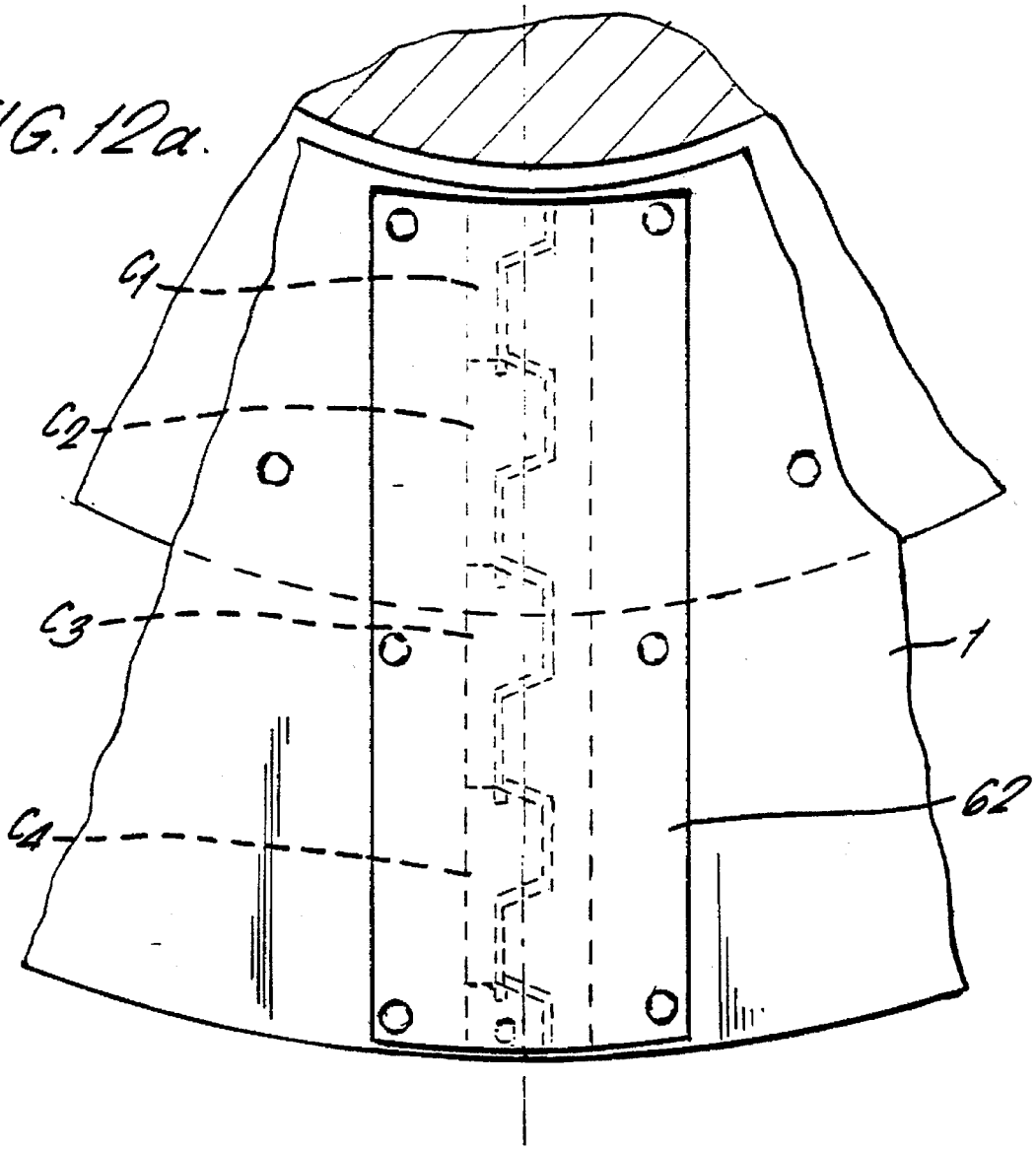
Figure 12B:
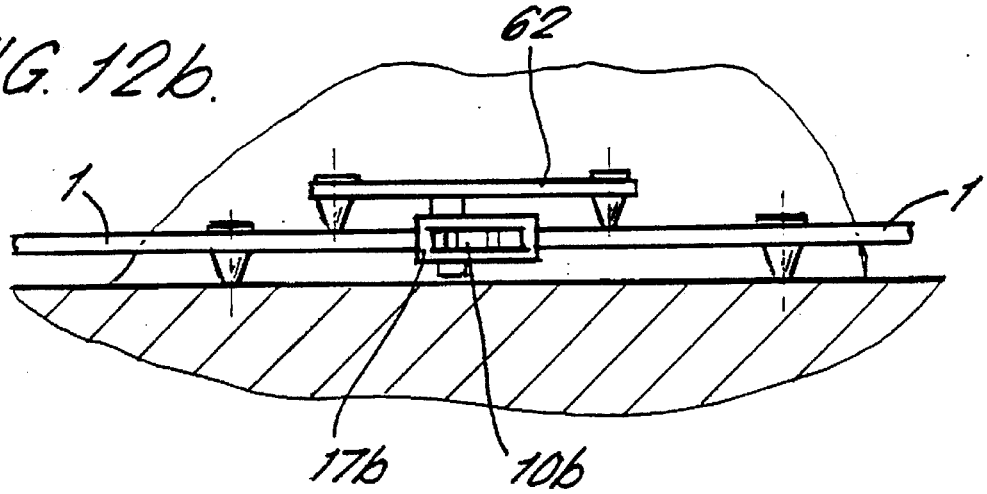
Figure 13A:
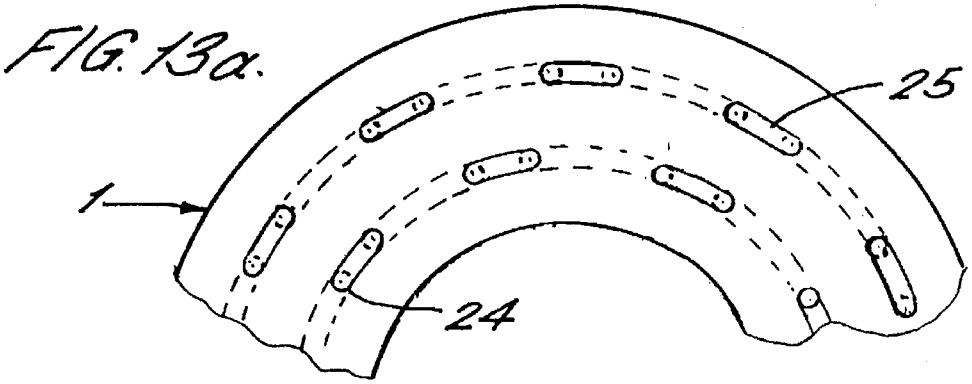
Figure 13B:
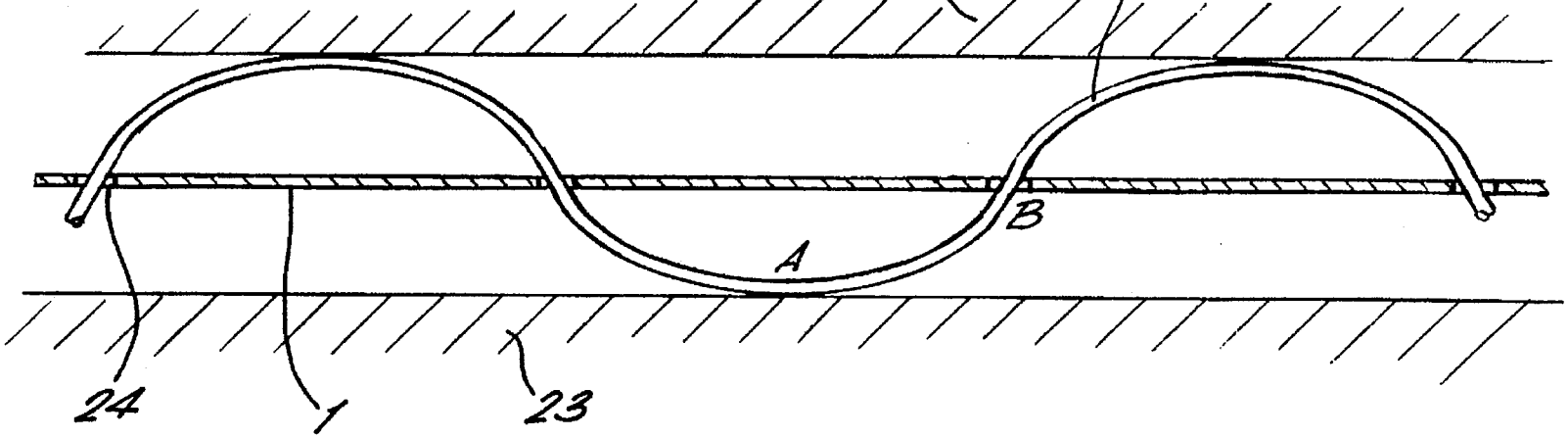
Figure 14:
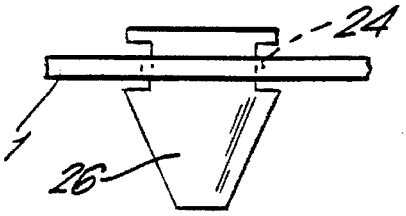
Figure 15:
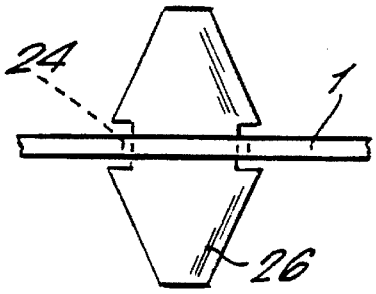
Figure 16:
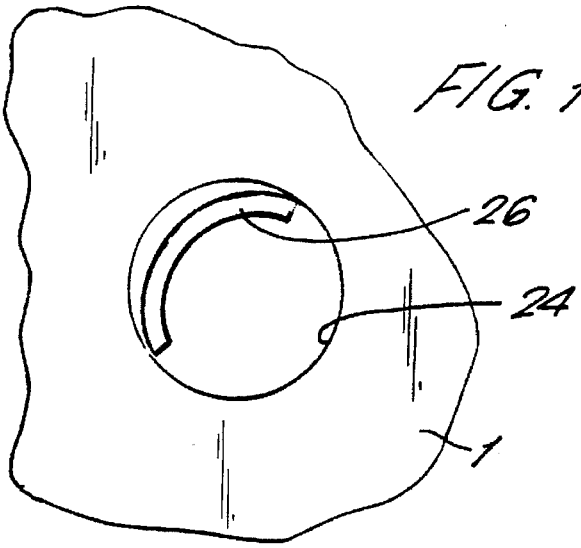
Figure 17:
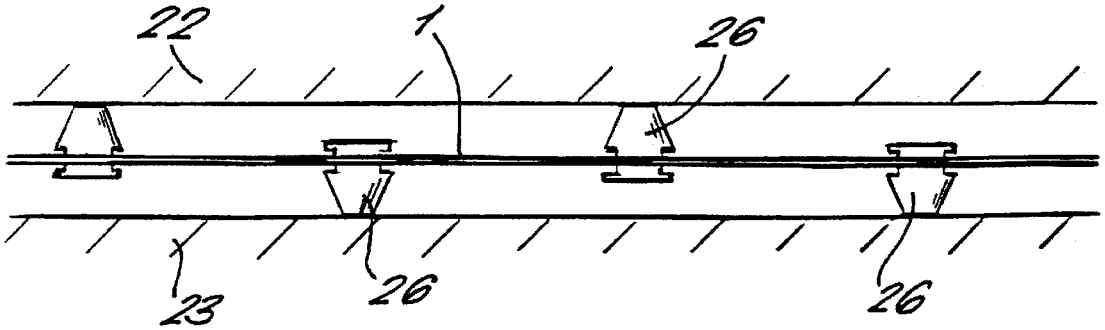
Figure 18:
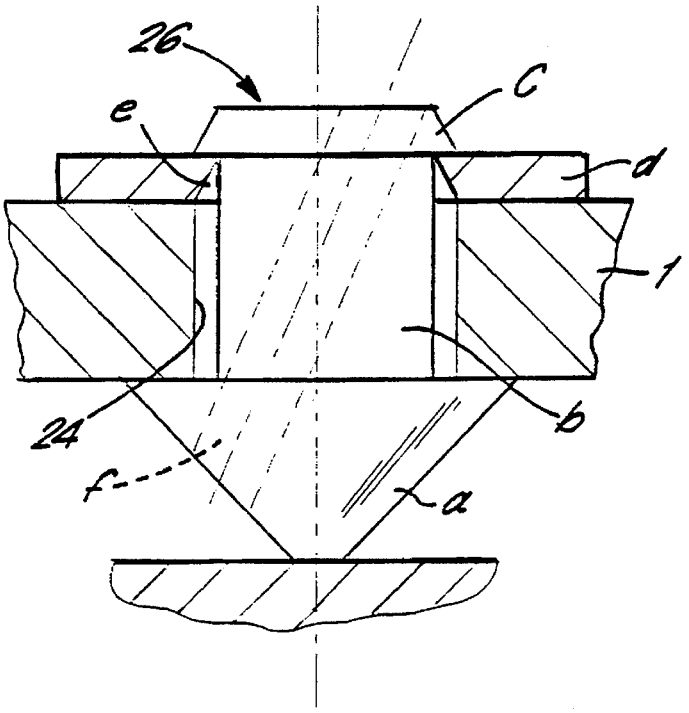
Figure 19:
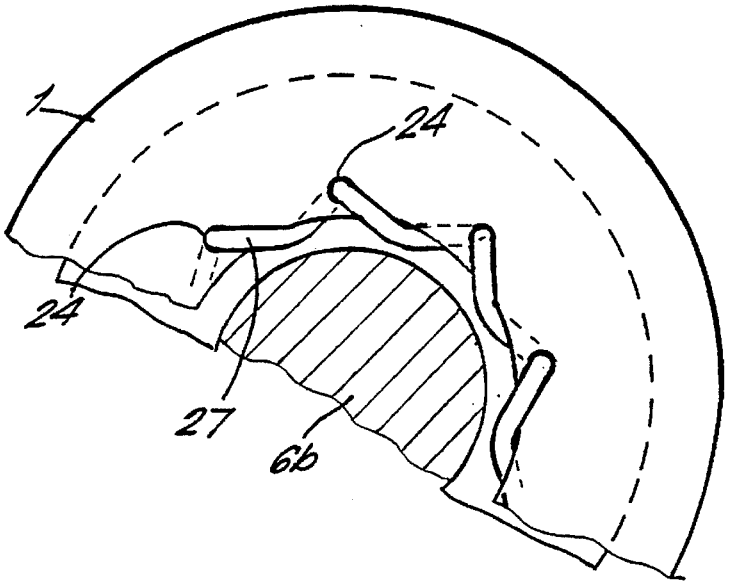
Figure 20:
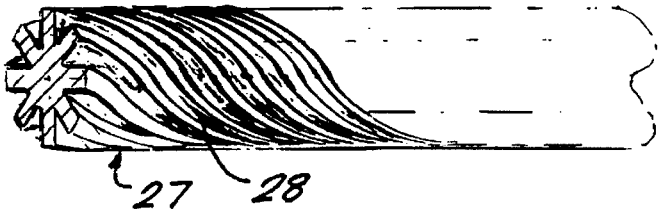
Figure 21:
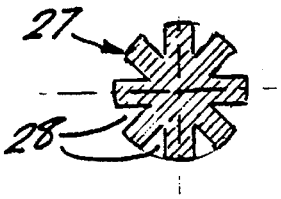
Figure 24:
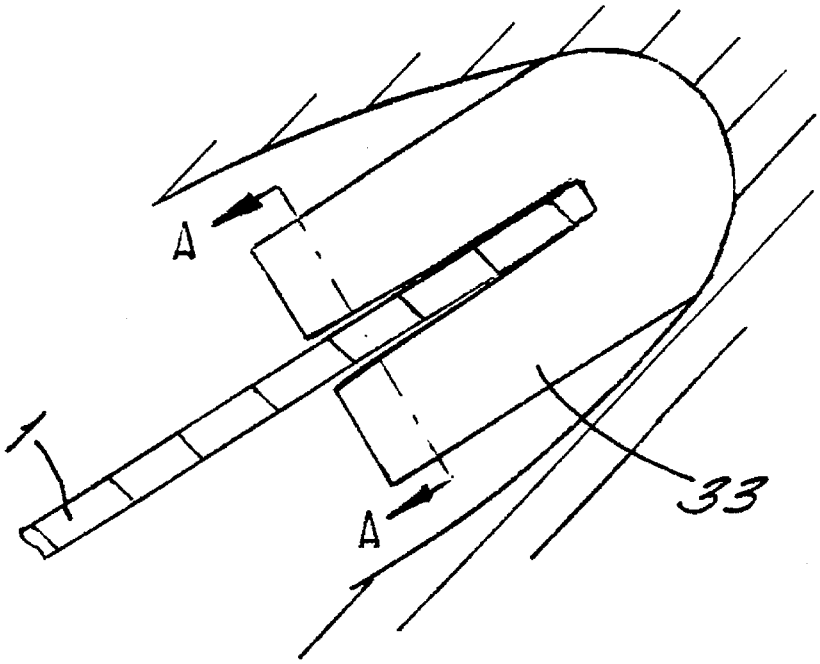
Figure 25:
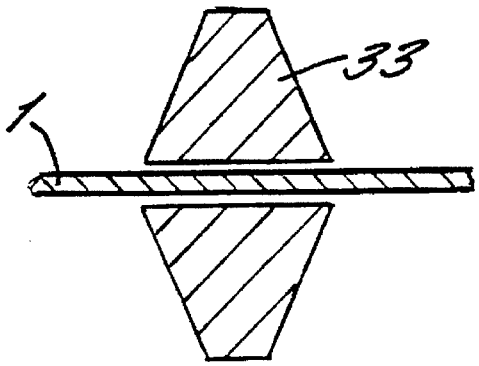
Figure 26A:
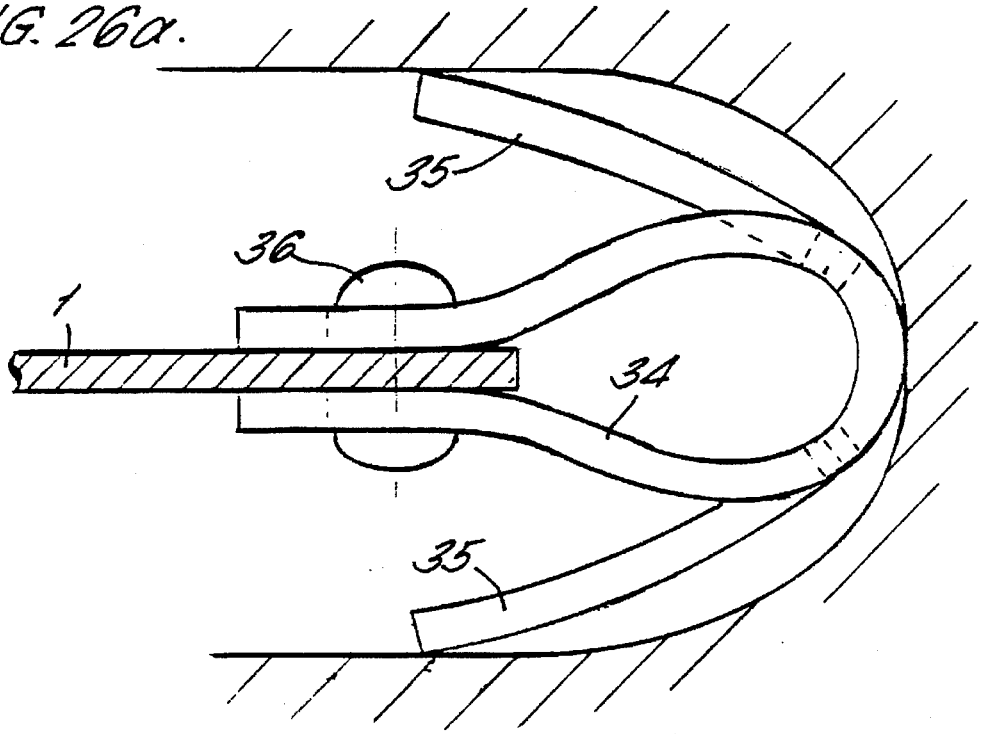
Figure 26B:
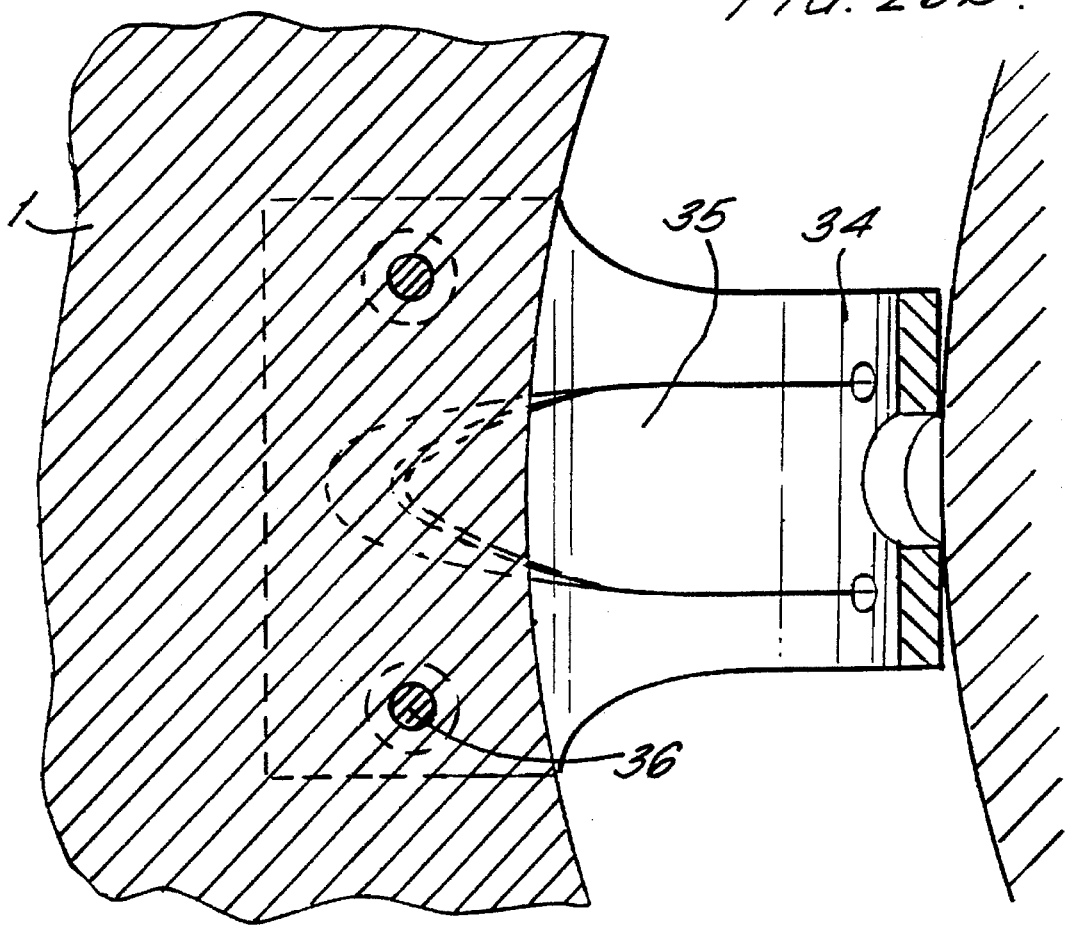

FIGS. 12*a* and 12*b* show a barrier according to the present invention with a cover plate in situ on an insulator;

FIG. 13*a* is a partial plan view of a barrier in accordance with a further preferred embodiment;

FIG. 13*b* shows how a barrier of the type depicted in FIG. 8*a* can be spaced between adjacent sheds of an insulator;

FIGS. 14 and 15 show types of peg sections which can be used for spacing a barrier between adjacent sheds of an insulator;

FIG. 16 is a plan view of FIG. 14 which shows how the peg sections depicted in FIGS. 14 and 15 can be flexed for insertion in the holes of a barrier;

FIG. 17 shows a barrier in position between adjacent sheds of an insulator;

FIG. 18 shows details of a further peg section which can be used to space the barrier;

FIG. 19 shows how a barrier can be spaced from the central portion of an insulator;

FIGS. 20 and 21 are an elevational view and a cross-sectional view respectively, of a preferred form of spacing extrusion for use in the arrangement of FIG. 19;

FIGS. 22, 23*a* and 23*b* show two formations which can be attached to a barrier to space it between adjacent sheds;

FIG. 24 shows a further formation for spacing a barrier from the core;

FIG. 25 is a cross-sectional view in direction A—A of FIG. 24;

FIG. 26*a* is an elevational view of a spacing clip in position on the inner edge of a barrier;

FIG. 26*b* is a plan view of the clip in FIG. 26*a;*

Figure 27:
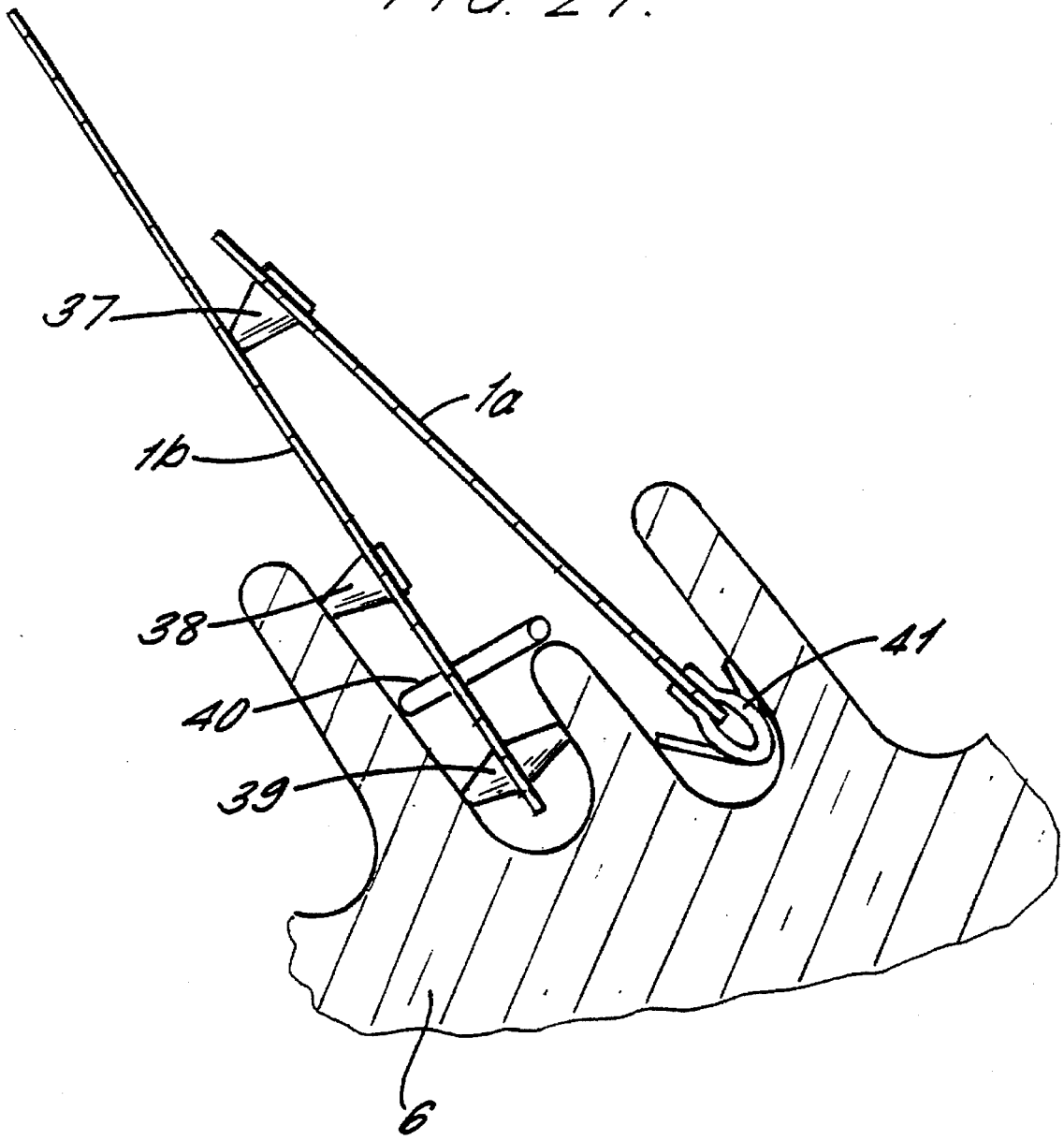

FIG. 27 shows how different spacing means can be combined on an insulator.

Figure 28:
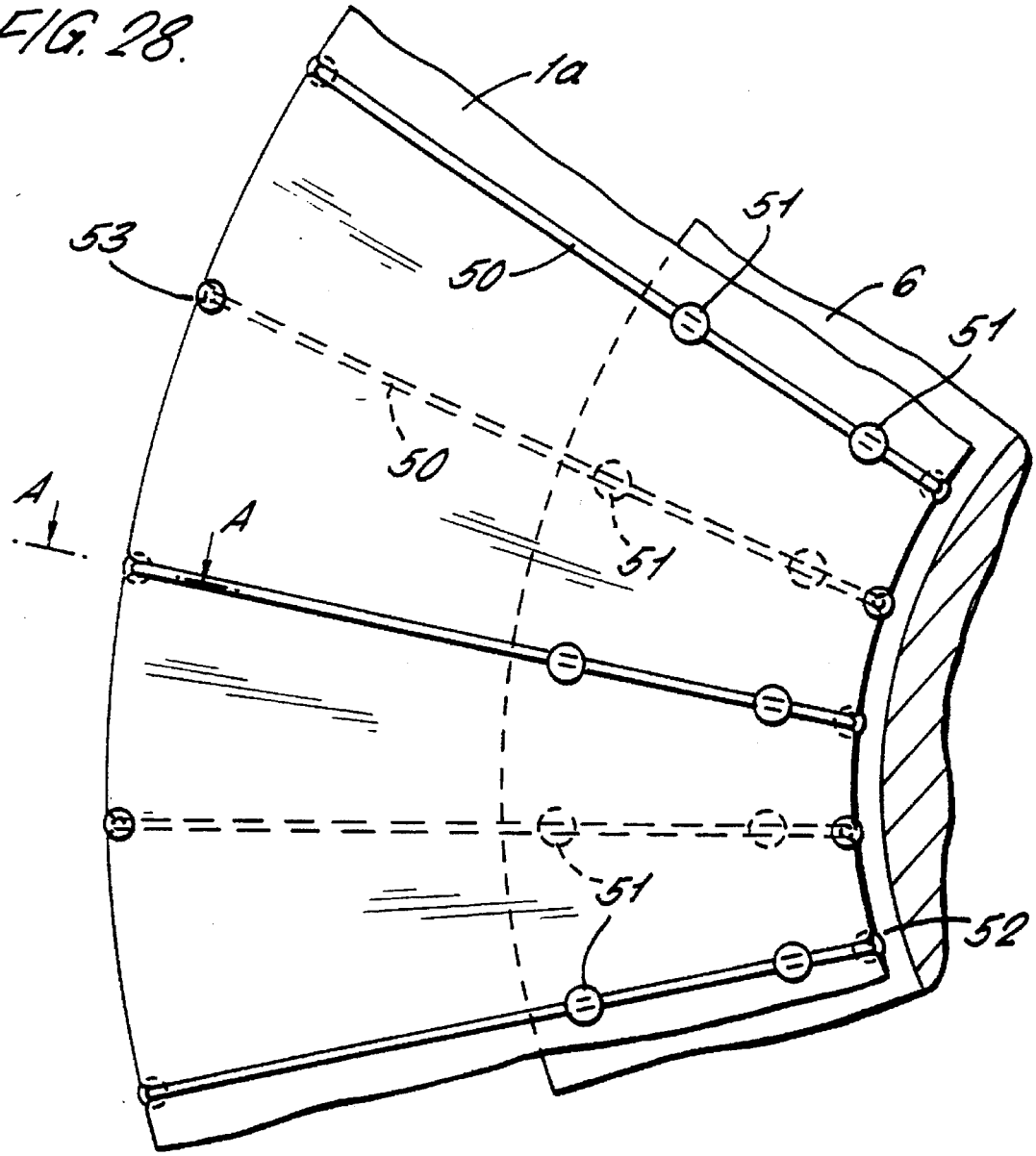
Figure 29:
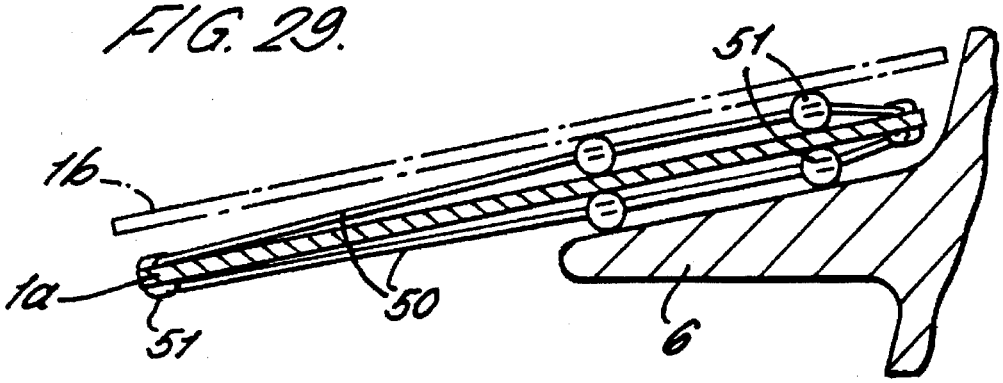
Figure 30:
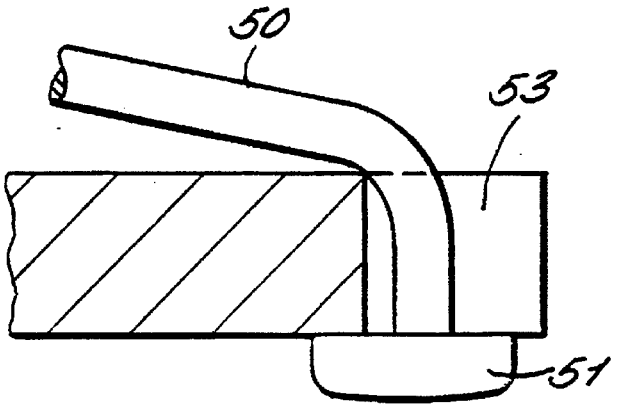
Figure 31:
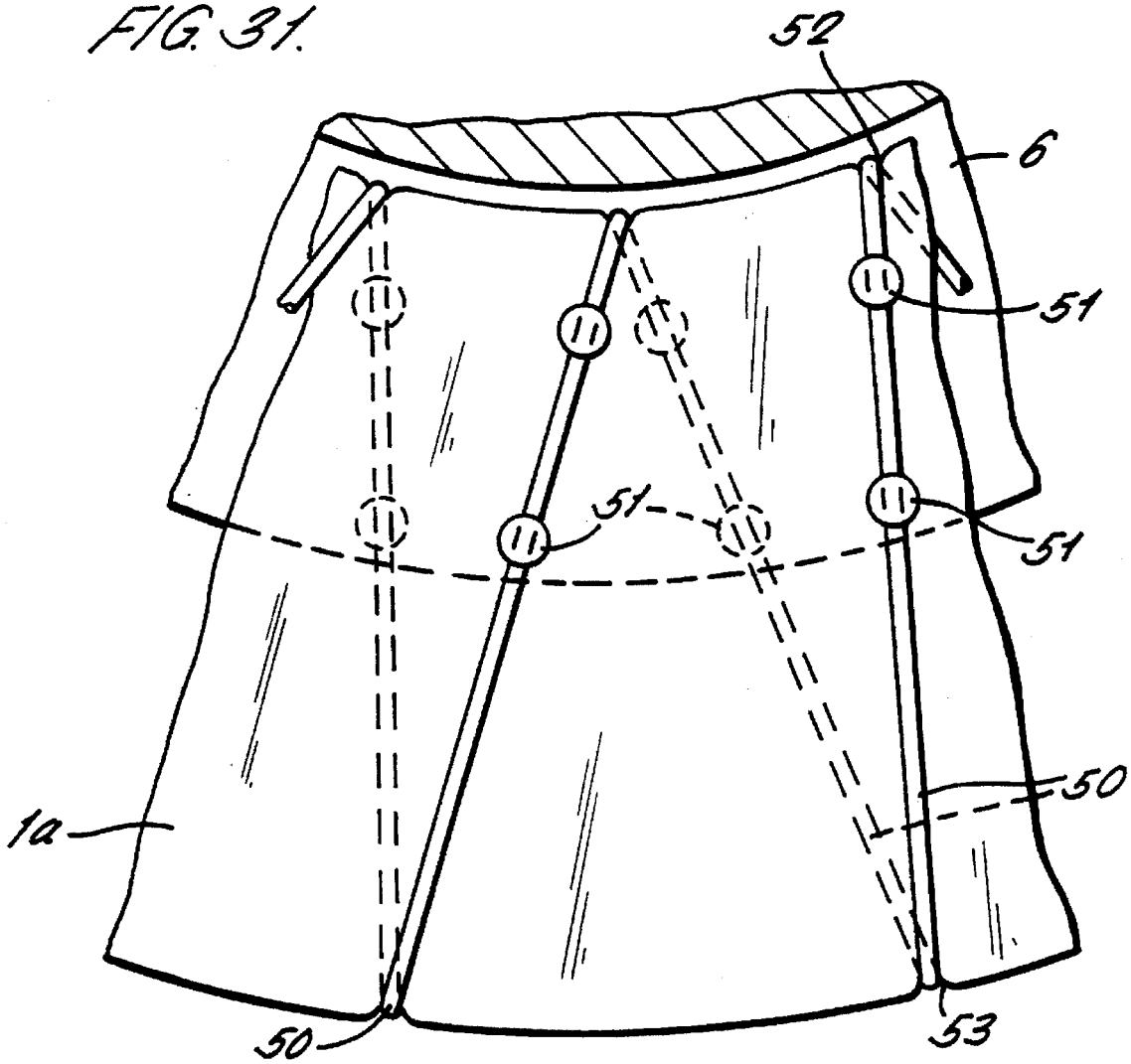
Figure 32:
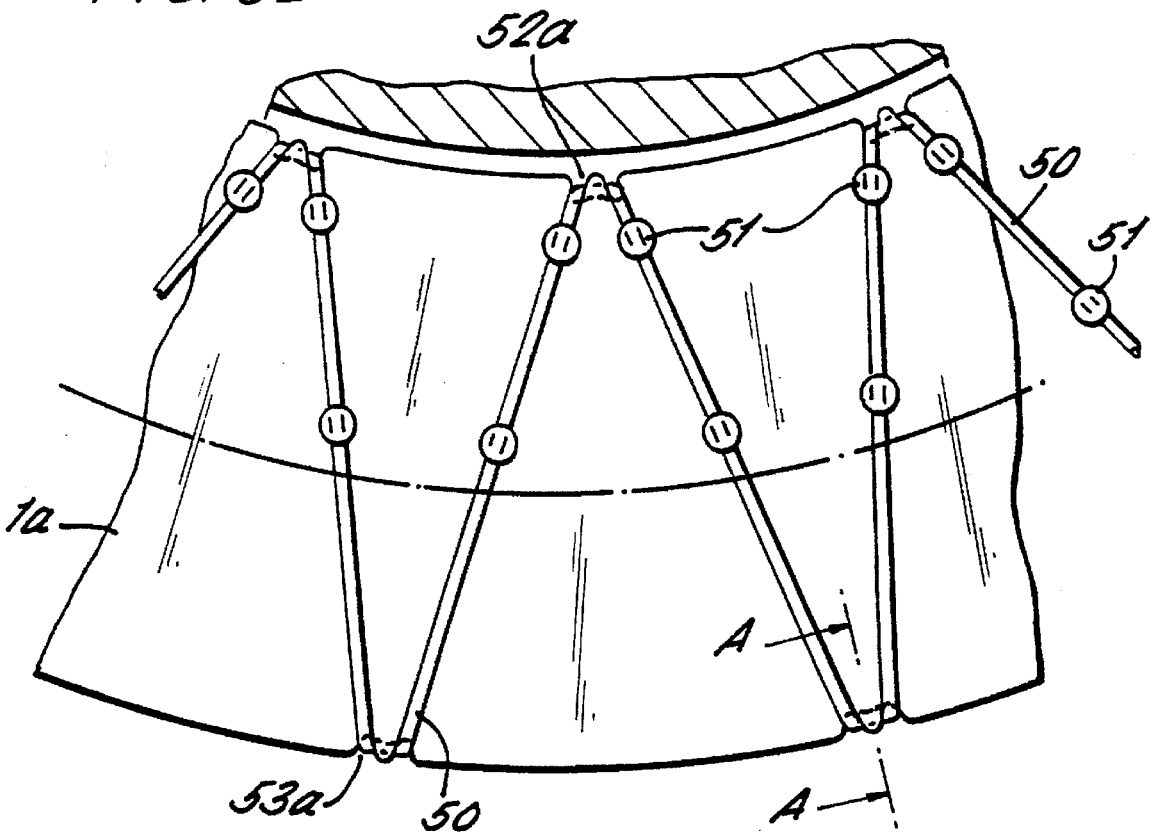
Figure 33:
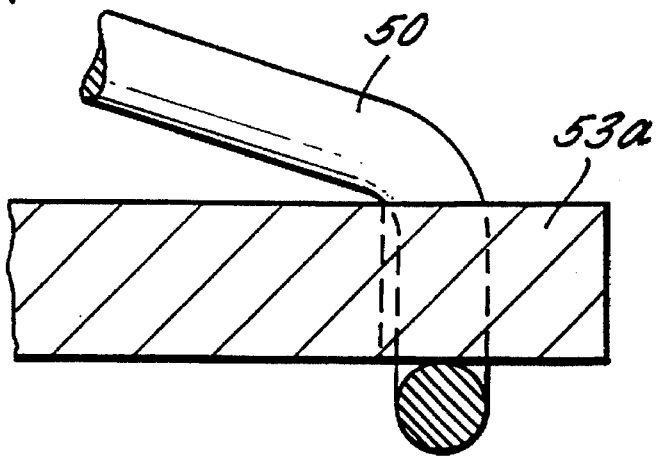

FIG. 28 shows an alternative combined spacing means to that depicted in FIG. 27;

FIG. 29 is a side view of the arrangement in FIG. 28;

FIG. 30 is a view in direction A—A in FIG. 28;

FIG. 31 depicts a further arrangement for combining spacing means;

FIG. 32 is yet a further arrangement for combining spacing means;

FIG. 33 is a view in direction A—A in FIG. 32.

DETAILED DESCRIPTION OF THE PREFERRED EMBODIMENTS

The barrier of the present invention comprises a flat sheet 1 of flexible insulating material cut in the shape depicted in FIG. 1. The flat sheet 1 can be bent into the shape of a truncated cone by joining the edges 2. The simple construction of the barrier allows a wide range of materials to be used since a moulding operation is not required. Thus, by a suitable choice of material, the thickness of the barrier can be reduced considerably from that required in GB 1542845 and earlier designs—the main limitation being the ability of the sheet to support itself and wind and ice and snow loadings and the ability to withstand puncture as required by the barriers of the prior art.

FIG. 2*a* is a partial plan view of a means for joining the edges 2 of the flat sheet 1. Holes 3 are made along the edges 2 such that the holes along one edge are staggered with respect to the other edge. A cylindrical spiralled rod 4 of insulating material can then be introduced into the holes from the outer edge of the barrier once it is in position on an insulator. The rod 4 can be rotated towards the central stem of an insulator until it abuts the central stem. To prevent the rod 4 from releasing the barrier it is only necessary to limit rotation. This can be done by, for example, using a shorter spiralled rod and blocking one of the outermost empty holes once the rod is in position. Alternatively, resin could be glued to one turn of the rod to prevent it passing through a hole or deforming the rod for the same purpose.

With this and all other methods described of joining the edges 2 of the barrier, the fitting of the barrier in position on an insulator is facilitated in the case of closely spaced adjacent sheds. This type of barrier is particularly advantageous because it is not necessary to move the edges 2 of the joint perpendicular to the plane of the flat sheet 1 and clamp them together with tongs as required in previous arrangements which made use of pegs in one edge of the barrier and holes in the other. Furthermore, the air gap between the edges 2 prevents the problems of tracking and puncture experienced in solid joints which comprise pegs and holes with an insulating filler.

For very large porcelain sheds the barrier 1 may be made up from several smaller segments jointed before installation on the insulator as depicted in FIG. 2*b*. The segments are jointed in any one of the manners described herein and one joint is left to be made in situ on the insulator.

FIG. 3 depicts a further embodiment of a barrier 1 in position over a porcelain shed 6*a* of an insulator. The barrier 1 is formed by overlapping the edges of a sheet only in the region which extends beyond the outer rim 7 of the porcelain shed 6*a*. The edges of the sheet which lie within the outer rim 7 have a gap 8 therebetween. The edges of the sheet outside outer rim 7 are joined by bolts 9 passing through holes in the edges. This arrangement provides all the advantages gained by providing a gap within the outer rim 7 whilst allowing the barrier 1 to be easily located and removed from an insulator because the bolts 9 lie outside the sheds and accordingly, are relatively easy to insert and remove.

In FIG. 4 a further arrangement for joining the edges 2 of a barrier is shown. As in FIG. 2 the edges 2 are provided with sets of holes 3*a* and 3*b*. A cylindrically spiralled insulating rod 4*a* is inserted into the holes 3*a* in one edge and a similar cylindrically spiralled rod 4*b* is inserted into the holes 3*b* in the other edge. The spirals of each of the rods 4*a* and 4*b* rotate in the same sense. The barrier is then assembled on an insulator and a straight rod 10 is inserted to link both spiralled rods 4*a* and 4*b* thus holding the barrier in position. The spiralled rods can be inserted prior to fitting the barrier on the insulator and can be prevented from coming out by any of the methods already described in connection with FIG. 2*a*. In addition, the ends of the spiralled rods 4*a* and 4*b* which will lie closest to the central stem 6*b* or core of the insulator could be deformed prior to location on the insulator to prevent removal.

FIG. 5 shows how the straight rod 10 in FIG. 4 could be shaped to spring it in position on insertion and to prevent withdrawal from the spiralled rods 4*a* and 4*b*. The pointed tip 11 also makes the rod 10 easier to insert but it could not be removed without cutting the barrier or the rod.

FIGS. 6*a* and 6*b* depict a further preferred rod 10 which can be used in the arrangement of FIG. 4. The rod 10 has a cross-section as shown in FIG. 6*a*. The rod 10 has grooves 12 spaced along its longitudinal axis which can be seen in FIG. 6*b*. FIG. 6*a* is a cross-sectional view in direction A—A of FIG. 6*b*.

The grooves 12 do not extend around the entire outer circumference of the rod 10 but extend only along opposite faces 13 and 14. The grooves 12 in the faces 13 and 14 are staggered with respect to each other. Thus, the rod 10 can be inserted such that the faces 15 and 16 without grooves lie at right angles to the plane of the barrier. When the rod is in position it can be rotated by 90 degrees so that the grooves 12 in faces 13 and 14 engage the turns of the spiralled rods 4*a* and 4*b* thus preventing the rod from coming out unless it is rotated again. The rod 10 could be prevented from turning by a pin extending through it at the end furthest from the insulator core 6*b*.

FIGS. 7*a* and 7*b* show a further preferred arrangement for joining the edges of a barrier. There are strips 17 and 18 cut from sheet insulating polymeric material which have loops 19 extending into the gap 8 formed by the edges of the barrier. The loops 19 on each of the strips 17 and 18 are staggered with respect to each other so that they can be interlocked to allow a rod 10 to pass therethrough. The strips 17 and 18 can be connected to the edges of the barrier by means of bolts 20 or glued pegs, rivets or eyelets, for example. Again, the rod 10 can be held by a pin 21 to avoid it coming out.

Alternatively, the edges 2 of the barrier could be cut and bent over to provide loops of a similar type to those depicted in FIGS. 7*a* and 7*b*. FIG. 7*c* is a view similar to FIG. 7*b* where the edges 2 have been cut and folded over. This avoids the need for separate strips such as 17 and 18 in FIG. 7*a*. FIGS. 7*d* and 7*e* are plan views of two alternative ways in which one might cut the material to provide the loops in FIG. 7*c*. The segments shown in FIG. 2*b* may be joined also before assembly on an insulator by the use of the tongues shown in FIG. 7*e* passing through slots or holes formed near the corresponding edge of the adjacent segment and then joined by forming the tongues into loops held together by fixing bolts or other similar means through the holes shown in FIG. 7*e*.

FIGS. 8*a*, 8*b* and 8*c* depict a further preferred arrangement for joining the edges of a barrier. In this embodiment, U-shaped strips 17*a* and 18*a* fit around the edges 2 of the barrier 1. The strips 17*a* and 18*a* are provided with projections 19*a* and are arranged such that the projections on strip 17*a* interlock with the grooves between the projections on strip 18*a*. The projections 19*a* can be tapered to facilitate construction of the joint on site. As in previous embodiments, there is a fixing rod 10*a* which passes alternately between the projections 19*a* of each strip 17*a* and 18*a*.

FIG. 8*a* is a side view of the joint and FIG. 8*b* is a plan view in direction A—A of FIG. 8*a*. In FIG. 8*a* the bolts 20*a* which hold strips 17*a* and 18*a* in place on the barrier 1 can be seen. The joint also comprises an extruded cover plate 50 which is held in position above the joint by means of a support 51 on a support bolt 53 located in one of the holes provided for the bolts 20*a*. FIG. 8*c* is a cross-sectional view in direction B—B of FIG. 8*b* of only one side of the joint. The cover plate 50 is provided with a slot 52 in which support 51 can slide. The cover plate 50 is preferably locked by a single screw connecting it to support 51.

The provision of cover plate 50 is optional but could be particularly advantageous in certain weather conditions. Since all the joints described herein have a gap between the edges of the barrier, on near-vertical insulators it is possible that in snow or icy conditions, when the temperature fluctuates about freezing point, the partial melting and freezing would allow icicles to grow through the gap and thus reduce its effectiveness. A cover plate 50 as depicted in FIG. 8*a* above the joint would reduce the risk of snow and ice filling the gap between the edges of the barrier. Such a cover plate will also increase the length of any discharge passing through the barrier because of the increase in the shortest path length available and the instability of the discharge when constrained in this way. The voltage drop per unit discharge length will also increase because of the increased pressure as a result of heating of the atmosphere in the narrow gap in which the discharge is forced to run, and ablation of the barrier material. Thus, the cover plate will counteract the reduction in the electric strength of the barrier over an open joint. The cover plate 50 is held by a number of support bolts 53 or the like after the U-shaped strip 17*a* has been assembled on the barrier 1 but before the barrier is jointed on site. A cover plate could also be applied to the underside of the barrier 1 on the other strip 18*a*. The cover plates 50 could extend for all or part of the length of the joint and could be curved to approach the barrier and spaced from it by spacers of the type which will be described later with reference to FIGS. 12 to 25.

FIGS. 9*a*, 9*b* and 9*c* depict a further joint having a similar profile to that in FIGS. 8*a*, 8*b* and 8*c* but an alternative method of connecting strips 17*b* and 18*b* to the edges of the barrier 1. Whereas strip 17*b* as depicted in full only the outline of interlocking strip 18*b* is indicated in FIG. 9*b*. FIG. 9*a* is a side view of the joint where it can be seen that the profile is very slim compared to the joints in FIGS. 8*a* and 7*b*—this is primarily due to the fact that no connecting bolts are used. The strip 17*b* is connected to the edge of barrier 1 by means of interlocking tongues 60 which co-operate with the hollow rectangular cross-section of strip 17*b*. Strip 17*b* is a hollow tube of rectangular cross-section with portions cut away to form tapered projections 19*b*. Strip 18*b* is formed in a similar manner so that the projections 19*b* of each strip 17*b*, 18*b* will interlock easily during construction of the joint. FIG. 9*b* is a cross-sectional view in direction A—A of FIG. 9*a* and shows clearly how the tongues 60 interlock with strip 17*b*. There are a number of slots 61 cut away from strip 17*b* opposite and between the tapered end of each projection 19*b* into which tongues 60 can slide. Each tongue 60 has a narrow leg portion 60*a* and a wider foot portion 60*b*. The slots 61 are slightly wider than the foot portion 60*b* to allow the connection of strip 17*b*. When the foot portion 60*b* has cleared the slot 61 and lies within the hollow interior of strip 17*b*, the strip 17*b* is pulled to one side (in this case from right to left). The strip 17*b* will then be secured by glue or a single insulating screw/pin at one end of the strip preferably the end which will lie at the outer rim of the barrier 1. The strip 17*b* can be made in a number of short sections $C_1$, $C_2$ . . . as shown in FIG. 9*a* which makes assembly easier, and there is no need for additional securing screws.

FIG. 9*c* is a cross-sectional view in direction B—B in FIG. 9*b*. In this figure, the hollow rectangular form of strip 17*b* is clear and the fixing rod 10*b* which will pass alternately between projections 19*b* of strips 17*b* and 18*b*.

The joint shown in FIGS. 9, 9*a*, 9*b* and 9*c* is potentially the thinnest of all those shown because this joint has no securing means such as bolts 20*a* in FIGS. 8*a*, 8*b* and 8*c* projecting into the gap between the sheds. Thus it can be used on insulators with small gaps where the use of other barrier designs might not be feasible. Each embodiment of the present invention described herein makes use of a joint where the edges of the barrier are offered up in the plane of the dielectric sheet for assembly on the insulator and the fixing rod is also inserted in that plane, thus requiring no space for clamping tongs to be inserted round an open overlapping joint as is the case for the joint described in GB 1,542,854.

The joint in FIGS. 9*a*, 9*b* and 9*c* can also be provided with a cover plate 62 for the reasons outlined in connection with FIGS. 8*a*, 8*b* and 8*c*. The cover plate 62 is an integral moulded section comprising a plate a, and a series of supports b, each provided with a foot c. In order to fit cover plate 62, the strip 17*b* must be formed in sections $C_1$, $C_2$, etc. As each support b is bent into position the end of a new section c is pushed into position against it to lock it in place. FIG. 10 depicts the assembly of a cover plate 62 in this way. Clearly, the spacing of supports b and length of sections $C_1$, and $C_2$, etc must be matched and the cover plate 62 must be flexible to allow assembly in this manner. The cover plate 62 is shown having spacers 63 to space the cover plate as required from the barrier.

FIGS. 11*a*, 11*b* and 11*c* depict a further joint which is a variation on FIGS. 9*a*, 9*b* and 9*c*. In this joint, it is possible to lock strips 17*b* and 18*b* onto the edges of the barrier 1 without additional screws or the like. This is achieved by wedge-shaped projections 65 provided on the interior surface of strips 17*b* and strip 18*b*. The projection 65 is sloped in two directions as shown in FIGS. 11*a*, 11*b* and 11*c*. The sloping projection 65 is such as to allow the introduction of a tongue 60 into the hollow interior of the strip 17*b* but to hinder its removal. The strip 17*b* is made suitably flexible to allow assembly in this way. FIG. 11*b* is a cross-sectional view in direction A—A in FIG. 11*a* and FIG. 11*c* is a cross-sectional view in direction B—B in FIG. 11*b*.

FIGS. 12*a* and 12*b* show a plan view and a side view of a typical barrier and cover plate according to FIGS. 9*a*, 9*b* and 9*c* and FIG. 10 in situ on an insulator.

FIGS. 1 to 12 have all depicted arrangements for joining the edges of a barrier for use on an insulator such that its surface is discontinuous and some of which will allow quick and easy removal for inspection, for cleaning or for any other reason.

A limitation of the prior art arrangements is that it is not possible to remove and replace a booster shed easily for examination because of the difficulty in breaking and remaking the joint, which needs to be thoroughly cleaned before re-gluing, as well as the difficulty in fitting the shed and rejoining it. This has meant that barriers of this type are rarely removed and only sample barriers could be checked for their condition. Furthermore, routine cleaning of the insulator surfaces near the barrier could be achieved only by hose washing so that the surfaces could not be checked for cleanliness. In any case, hose washing is a technique that cannot be used with some equipment, e.g some transformers, because of the risk of water from stray upward spray getting into the equipment through the breather.

The jointing methods according to the present invention overcome the problems encountered in the prior art by avoiding the gluing of the edges of the barrier such that removal of the barrier or replacement is facilitated. The barriers can be removed to enable their cleaning and inspection and also cleaning and inspection of the insulator surfaces. Furthermore, any in situ surface coating treatment of the porcelain, whether to restore water repellency or for any other reason, can be done on a regular basis without difficulty.

FIGS. 13 to 27 will now depict arrangements which allow the optimum spacing of a barrier (as described with reference to any of FIGS. 1 to 12) from a shed of an insulator and/or from the central core of the insulator. The means for spacing the barrier all make use of discontinuities or holes in the barrier.

Although a lowering of flashover voltage across the shed of a porcelain insulator and thus a reduction in stress across the shed can be achieved by reducing the distance by which the barrier extends beyond the outer edge of the porcelain, some overlap is necessary to shield as much as the insulator as possible from rain and from cascading water, particularly in the case of near-vertical insulators. It is also possible to reduce the stress across the porcelain sheds by adjusting the position of the barrier in the gap between adjacent sheds. Prior art arrangements have always concentrated upon placing the barrier as close as possible to the surface of a shed in order that the formation of any arc over that surface is inhibited and any such arc that forms has a high arc voltage gradient. However, if the barrier is too close a discharge between the barrier and the insulator surface may cause damage to the insulator surface by burning as well. This balance of conflicting requirements was usually determined empirically.

FIGS. 13*a* and 13*b* show how a barrier 1 can be suitably positioned between adjacent shed surfaces 22 and 23. The barrier 1 is provided with holes 24 which are spaced such that there is equal spacing between alternate holes. The holes can be on the circumference of one or more circles which are concentric with the insulator axis. An insulating rod or filament 25 is then threaded through adjacent holes on a circumference as shown in FIGS. 13*a* and 13*b* such that when the barrier is located between adjacent sheds it can be positioned as required between the shed surfaces 22 and 23. The use of flexible rods or filaments are preferred because assembly would be easy and the barrier 1 could adapt to different spacings. Flexibility will allow automatic adjustment if there are small differences in spacings between sheds whilst still providing a positive positioning force. In addition, this arrangement will give a particularly high surface resistance coefficient between the barrier and a supporting shed (for example between points A and B in FIG. 13*b*). The high surface resistance of the support will reduce the loss of charge from the barrier to a supporting shed. Suitable materials for the rod or filament 25 are readily available in the required form. The ends of the rod or filament 25 could be bent, distorted or coated with a layer of resin to ensure that they remain in place. Alternatively, the rod could be glued into one or more of the holes 24.

Experiments have shown that holes in polymer sheds do not render them ineffective in the case of a.c insulators nor do holes in barriers in the critical case where non-uniform wetting exists on near horizontal d.c wall bushings. The presence of holes in an insulating barrier in an air gap does not reduce the breakdown voltage for a positive point electrode for the spacings under consideration. It does for negative polarity but this gives higher gap strength without barriers anyway. Accordingly, the arrangement can be used to improve the performance of insulators for both direct and alternating voltage. The original barriers (booster sheds as described in GB1542845, for example) were intended for use on near vertical a.c insulators.

The holes 24 act to limit the voltage appearing across the barrier 1 and thus inhibit puncture and tracking. Since puncture is inhibited the barrier can be made thinner thus allowing increased clearance from the surfaces of adjacent insulator sheds.

FIG. 14 shows how a peg section 26 can be placed in a hole 24 to achieve spacing of the barrier 1 from a surface of a shed. The peg section 26 is cut from a sheet of insulating material which may be of the same composition as barrier 1. A peg section 26 can be inserted into a hole 24 by bending it as shown in FIG. 16 and allowing it to spring back into position. The peg sections 26 can be single-sided as shown in FIG. 14 or double-sided as shown in FIG. 15.

The peg sections 26 could be arranged such that they are staggered in the manner depicted in FIG. 17 which is a schematic view in the plane of the barrier.

FIG. 18 depicts a further insulating peg 26 suitable for spacing the barrier 1 from the surface of a shed. The peg 26 passes through a hole 24 in the barrier 1 and is locked in position by an insulating washer d. The peg 26 has a tapered head a, a body section b and a tapered tail C. The peg 26 will be pushed through barrier 1 from below and the washer d will then be pushed over tail C. The washer d has a tapered hole e with a minimum diameter slightly smaller than the maximum diameter of tail C. The elasticity of the materials should be such as to allow the washer d to be located in this way. Alternatively, the hole 24 in barrier 1 could be tapered in the same way as the washer d thus avoiding the need for the washer. In addition, the surface of peg 26 could be provided with serrations or teeth to hamper removal once positioned in the barrier. The peg 26 also has a hole f running through it at an angle to its longitudinal axis. The lower end of hole f is offset from the point where the head a contacts the shed. Hole f allows a discharge to pass through the barrier 1 without being too close to the porcelain shed to damage it.

FIGS. 19, 20 and 21 show how the inner edge of a barrier 1 can be suitably spaced from the central stem of an insulator.

The barriers already known required elaborate cutting of their inner edge to form the scallopped affect required by GB 1542845, for example and accurate cutting of the tongues if the barrier was to be held in position. However, the edge need not be accurately cut providing that a clearance of not less than 3 mm to the central porcelain core or stem, and preferably 5 mm, is ensured.

In FIG. 19 a barrier 1 is spaced from the central porcelain core 6*b* by feeding an extruded soft polymer strip 27 through holes 24 arranged around the inner edge of the barrier 1. This arrangement provides both spacing from the central insulator core 6*b* and spacing between adjacent sheds of the insulator when the barrier is assembled. The edges of the barrier can be joined in any of the ways described earlier.

FIG. 20 shows a preferred embodiment of a strip 27 which has spiralling grooves 28 along its length and is star-shaped in cross-section as is clear from FIG. 21. A strip 27 formed as in FIGS. 20 and 21, will reduce the area of contact between itself and the porcelain insulator thus reducing the risk of water being trapped by capillary attraction and causing unwanted leakage currents.

In FIG. 22, polymer strips 29 in a looped shape can be fixed through the holes in a barrier 1 to provide support and clearance from the shed surface. The strips 29 can be held in place by bolts 30, for example, eyelets or glued pegs.

FIG. 23*a* shows an alternative arrangement to that in FIG. 22 where moulded sections 31 are secured above and below a barrier 1 by means of bolts 32 passing through holes in the barrier or eyelets. The reduction in the width of sections 31 ensures a high surface resistance coefficient between the barrier and the shed. FIG. 23*b* is a plan view of the arrangement in FIG. 23*a* where the narrowing of the sections 31 can be clearly seen.

FIG. 24 depicts a barrier 1 radially spaced from the core of an insulator by means of a strip of polymeric material 33 in the form of a clip having a double triangular cross-section. FIG. 24 is a cross-section taken in direction A—A of FIG. 25.

In FIG. 26*a* a clip 34 is fitted to the inner edge of a barrier 1 which lies closest to the central core of an insulator. The clip 34 is held to the barrier 1 by eyelets, bolts, glued pegs or rivets 36. The clip 34 comprises a looped portion of resilient insulating material which has arms 35 extending outwardly therefrom. The arms 35 serve to space the barrier 1 between adjacent sheds and the end of the clip spaces the barrier 1 from the central core. This method is particularly suitable for a near-horizontal insulator where at least three clips 34 will be needed spaced around the inner perimeter of the barrier 1. If the insulator axis is nearly horizontal, the ends and arms of the clips 34 on the upper side will support the barrier 1 as required whilst the clips on the underside will hold the barrier in place by pressing against the adjacent porcelain sheds. FIG. 26*b* is a cross-sectional plan view of the arrangement in FIG. 26*a*.

Any of the arrangements described with reference to FIGS. 1 to 26 could be used singly or in combination as desired.

For example, to improve the performance of a near-vertical insulator in conditions of wetting where the presence of gaps in the barrier might reduce the effectiveness of a single barrier, two barriers could be used in close proximity with the angular position of the joints staggered so that a single discharge would not pass through both joints without a great increase in length thus increasing the flashover voltage of the insulator. FIG. 27 depicts such an arrangement where two barriers 1*a* and 1*b* are used being located by a combination of peg sections 37, 38 and 39, a flexible rod 40 and a clip 41. The peg sections, flexible rod and clip are each located in corresponding holes in the barrier (as described in connection with FIGS. 13*b*, 14, 15 and 26*a*).

Such an arrangement would also be effective for a near-horizontal HVDC wall bushing where the provision of high-resistance zones will reduce the risk of flashover and of radial puncture. With two barriers there is a semi-enclosed space around a shorter shed, for example, which produces a high resistance zone because it can be kept dry. Although the voltage across the zone could be very high, producing such a zone around a short shed reduces the risk of puncture at the shed root because the flashover voltage of this shed is less than that of the larger shed although the root thickness is nearly the same.

The arrangement in FIG. 27 demonstrates the following:

(a) the angle of the barriers 1 to the axis of the insulator need not approximate to that of the sheds;

(b) a flexible rod or filament 40 can be used to locate a barrier with respect to the end of a shed as well as the surface of a shed;

(c) several types of different spacing means can be combined, i.e pegs, clips and flexible rods in this case;

(d) the barriers can overhang the insulator by different amounts.

In such an arrangement, it is convenient to have different overhangs on the two sheds for a near-horizontal bushing. The small gap shown in FIG. 27 between the ends of the right hand barrier 1*a* and left hand barrier 1*b* is thus better screened by the extension of the left hand barrier 1*b* against rain driven by wind at different angles. The gaps where the barriers are joined would be arranged to be below the horizontal axis of the bushing but not vertically below the axis since water collects there and it is a preferential position for discharges.

FIGS. 28 to 33 depict further embodiments of double-barrier arrangements according to the present invention.

FIG. 28 shows in plan view how a barrier 1*a* can be spaced from the insulator 6 and from a second barrier 1*b* placed above it. The barriers 1*a* and 1*b* are jointed in any of the aforementioned ways and preferably arranged so that the joints are staggered by 180°. FIG. 29 is a side view of the arrangement in FIG. 28. The barriers 1*a* and 1*b* are spaced by means of an insulating filament 50 which carries a number of beads 51 of polymer or ceramic which are fixed by an adhesive or moulded thereon. The barriers 1*a* and 1*b* preferably have slots 52 in the inner periphery and slots 53 in the outer periphery. The slots 52 and 53 ensure that filament 50 does not slip when placed around the barrier 1*a* or 1*b*. FIG. 30 is a cross-section in direction A—A in FIG. 28 and shows the detail of a slot 53 in FIG. 28. In FIG. 28 several separate filaments 50 are used but it is possible, as shown in FIG. 31, to use a single filament by winding it continuously around the annular barrier. FIG. 32 uses an alternative winding method for the filament 50 where the beads 51 will be only on the underside of the barrier 1*a*. The filament 50 passes around W-shaped slots 52*a* and 53*a*. The barrier 1*b* which is placed above barrier 1*a* will also have a similar arrangement on its underside to space it from barrier 1*a*. FIG. 33 is a cross-section in direction A—A in FIG. 32 and shows the detail of how the filament 50 is wrapped around the W-shaped slot 53*a*.

The advantage of using the arrangement in FIG. 28 rather than the arrangement in FIG. 32 is that there will be no tendency for the barriers to bow upwardly since the tension on both sides of the barrier 1*a* is balanced.

Clearly, the filament 50 with beads 51 only on the underside could be used for a single barrier 1*a* if the holes in the barrier caused too great a reduction in flashover strength with heavy pollution. In this case, the barrier would need to be fairly rigid to take any pull from the filaments, but the filaments do not need to be tight provided that there is no risk of them becoming detached. A resin bonded fibreglass sheet would be suitable which is already in use for booster sheds.

The overhang of the barriers depicted in FIGS. 1 to 33 is important even though it is never complete around the outer periphery of the shed over which it is placed. The gap at the barrier joint acts in a similar way to the presence of holes in the barrier in that neither substantially affects the ability of the barrier to collect charge and both may provide advantages in limiting the voltage across the sheds in its proximity.

Experiments have shown that the barriers as described with reference to FIGS. 1 to 33 serve as field modifiers because charge is trapped on their surfaces thus the breakdown strength of the air gap in which they are placed is increased. Research carried out on the effects of such barriers on breakdown strength of the air gap have shown the following:

a) a very thin barrier is effective;

b) the barrier can be wet and still be effective;

c) punctures in the barrier do not render it ineffective;

d) the polarity effect is favourable, i.e for the polarity which gives the lower breakdown voltage for a point/plane geometry (i.e the electrode geometry giving the lowest breakdown stress), the effect of the barrier is greater on the breakdown voltage. This is also the polarity which is relevant to the polarity and wetting conditions for which the performance of a d.c bushing is the most critical;

e) the effectiveness of the barrier increases with its area.

The barriers described herein make use of the concept that charge can build up freely if the electrical resistance of the support between the barrier and the insulator is maintained at a high value even during rainfall. This can be achieved by a combination of the specific geometry of the support, the composition of the support material (high water repellency), and its location (the supports are shielded as far as possible from rainfall).

The barriers described all have openings in the form of holes or gaps between joining edges which reduce the dielectric strength. The reduction in effectiveness can be minimised or avoided by the design features described herein thus creating the following advantages:

(a) feasibility for use on insulators with small spacings between adjacent sheds;

(b) reduction of risk of damage to the barrier and insulator;

(c) simpler manufacturing methods;

(d) materials with optimum characteristics for their particular functions can be used for different components of the barrier;

(e) easier installation and reinstallation;

(f) easier inspection and maintenance;

(g) small barrier size.

Although the dimensions of the barriers have only been mentioned briefly it is desirable that the inner periphery of a barrier be spaced at least 3 mm from the central portion of the insulator, the barrier overhangs the outer periphery of a shed by at least 10 mm and the barrier should be spaced at least 5 mm from the shed surface. Of course, the dimensions of the barrier itself and its spacing and overhang will vary considerably according to its specific application.

I claim:

1. A barrier, in combination with an insulator having a central portion or stem with a plurality of sheds extending therefrom, the barrier being in use, located between adjacent sheds of the insulator, the barrier comprising a sheet of dielectric material, the barrier being spaced from the adjacent sheds, in use, and being shaped such that when the barrier is located between the sheds of the insulator the barrier forms a collar, the collar having edges connected to each other such that there is a gap therebetween to reduce tracking, a set of holes being provided along each edge of the collar, the sets of holes being staggered with respect to each other, and a spiraled rod threaded through the holes to join the edges.

2. The barrier as claimed in claim 1, wherein the collar is formed by the sheet of dielectric material in the shape of an annulus with a sector cut away.

3. The barrier as claimed in claim 2, wherein the annulus is cut into two or more sectors which are reconnected to form an annulus leaving gaps between the cut sectors.

4. The barrier as claimed in claim 1, wherein each of said sets of holes has a separate spiraled rod threaded therethrough, the spiraled rods being linked by a straight rod passing through a spiral of each of said rods alternately.

5. The barrier as claimed in claim 4, wherein the straight rod has an arrow-shaped tip to facilitate introduction and prevent withdrawal from the spiraled rods.

6. The barrier as claimed in claim 4, wherein the straight rod is provided with spaced grooves extending transversely to a longitudinal axis of the rod which cooperates with the spiraled rods to secure a joint in the barrier.

7. A barrier, in combination with an insulator having a central portion or stem with a plurality of sheds extending therefrom, the barrier being, in use, located between adjacent sheds of the insulator, the barrier comprising a sheet of dielectric material, the barrier being spaced from the adjacent sheds, in use, and being shaped such that when the barrier is located between the sheds of the insulator the barrier forms a collar, the collar having edges connected to each other such that there is a gap therebetween to reduce tracking, each edge of the collar being fitted with a separate component forming a set of spaced protrusions, the protrusions of one set being linked with the protrusions of the other set by a rod passing therethrough.

8. The barrier as claimed in claim 7, wherein each edge of the collar is cut, folded back and secured to form the set of spaced protrusions.

9. The barrier as claimed in claim 1 or claim 7, and further comprising means for spacing the barrier between said adjacent sheds.

10. The barrier as claimed in claim 9, wherein the spacing means comprise projections located on a flexible elongate element which is wrapped around the barrier.

11. The barrier as claimed in claim 1 or claim 7, wherein the dielectric sheet is provided with apertures, and means for spacing the barrier between sheds located in one or more of the apertures.

12. The barrier as claimed in claim 11, wherein the spacing means position the barrier such that, in use, the barrier is substantially equidistant between the adjacent sheds.

13. The barrier as claimed in claim 12, wherein, in use, the entire inner periphery of the barrier is spaced radially from the central portion or stem of the insulator.

14. The barrier as claimed in claim 11, wherein the means for spacing are flexible pegs.

15. The barrier as claimed in claim 14, wherein the pegs have holes therethrough which allow passage of a discharge through the barrier.

16. The barrier as claimed in claim 11, wherein the means for spacing is a flexible insulating filament threaded through the apertures.

17. The barrier as claimed in claim 16, wherein the apertures are spaced around the inner periphery of the barrier, and wherein the flexible insulating filament is threaded through one of the apertures in one direction, then passed around the inner periphery and through the next and subsequent apertures in the same direction, thus providing spacing both between the sheds and from the central portion or stem of the insulator.

18. The barrier as claimed in claim 17, wherein the filament is provided with spiraled grooves.

19. The barrier as claimed in claim 11, wherein the means for spacing the barrier between the sheds is a strip of flexible material secured in a loop through one or more of the apertures in the barrier.

20. The barrier as claimed in claim 11, wherein the means for spacing the barrier between the sheds are molded undulating sections secured through one or more of the apertures in the barrier.

21. The barrier as claimed in claim 11, wherein the means for spacing the barrier between the sheds and from an insulator core is one or more clips fitted through the apertures in the inner periphery of the barrier.

22. The barrier as claimed in claim 1 or claim 7, wherein, in use, inner periphery of the barrier is spaced from the central portion or stem of the insulator by at least 3 mm.

23. The barrier as claimed in claim 1 or claim 7, wherein, in use, the barrier extends beyond an outer periphery of one of the sheds by at least 10 mm.

24. The barrier as claimed in claim 1 or claim 7, which is, in use, provided with a cover plate over its connecting edges.

25. The barrier as defined in claim 1 or claim 7, wherein the barrier is provided on the insulator.

26. The barrier as defined in claim 1 or claim 7, wherein another barrier is arranged relative to the barrier such that said barriers are spaced from and adjacent to each other.

27. The barrier as claimed in claim 26, wherein said barriers lie at different angles to a longitudinal axis of the insulator.

* * * * *